US007474208B1

(12) United States Patent
Klein

(10) Patent No.: US 7,474,208 B1
(45) Date of Patent: Jan. 6, 2009

(54) METHOD AND SYSTEM FOR LOCATING AN OBJECT

(76) Inventor: Richard Ira Klein, 319 N. Vinewood St, Escondido, CA (US) 92029

( * ) Notice: Subject to any disclaimer, the term of this patent is extended or adjusted under 35 U.S.C. 154(b) by 239 days.

(21) Appl. No.: 11/432,110

(22) Filed: May 10, 2006

(51) Int. Cl.
*G08B 1/08* (2006.01)

(52) U.S. Cl. ..... 340/539.21; 340/539.15; 340/539.32; 340/573.1; 340/573.4; 340/574; 340/384.4; 340/384.6; 342/146; 367/2; 367/6; 367/128

(58) Field of Classification Search ..... 340/539.21, 340/539.15, 539.32, 573.1, 573.4, 574, 539.12, 340/571.1, 384.4, 384.6; 342/146; 367/2, 367/6, 128
See application file for complete search history.

(56) References Cited

U.S. PATENT DOCUMENTS

| | | | | |
|---|---|---|---|---|
| 4,797,671 | A | 1/1989 | Toal, Jr. | |
| 5,600,323 | A | 2/1997 | Boschini | |
| 5,652,569 | A * | 7/1997 | Gerstenberger et al. | 340/573.4 |
| 6,246,314 | B1 | 6/2001 | Djaid | |
| 6,265,988 | B1 | 7/2001 | LeMense et al. | |
| 6,292,107 | B1 | 9/2001 | Yamaura et al. | |
| 6,359,348 | B1 | 3/2002 | King | |
| 6,384,710 | B1 | 5/2002 | LeMense et al. | |
| 6,472,999 | B1 | 10/2002 | Lin | |
| 6,512,462 | B1 | 1/2003 | Robineau | |
| 6,518,882 | B2 | 2/2003 | Johnson et al. | |
| 6,529,142 | B2 | 3/2003 | Yeh et al. | |
| 6,604,000 | B2 * | 8/2003 | Lu | 607/17 |
| 6,611,201 | B1 | 8/2003 | Bishop et al. | |
| 6,696,983 | B2 | 2/2004 | Tang et al. | |
| 6,724,322 | B2 | 4/2004 | Tang et al. | |
| 6,781,519 | B1 | 8/2004 | Diaz | |
| 6,838,987 | B1 | 1/2005 | Quinonez | |
| 6,885,285 | B2 | 4/2005 | Losey | |
| 6,909,964 | B2 | 6/2005 | Armstrong et al. | |
| 2001/0038328 | A1 | 11/2001 | King et al. | |
| 2002/0173289 | A1 | 11/2002 | Pacsai et al. | |
| 2002/0190872 | A1 | 12/2002 | Suman et al. | |
| 2003/0197595 | A1 | 10/2003 | Olson et al. | |
| 2005/0134477 | A1 | 6/2005 | Ghabra et al. | |

OTHER PUBLICATIONS

Directed Electronics, Inc., Python Model 900 Owner's Guide, 2005, 61 pages, Directed Electronics, Inc., Vista, CA 92081, http://www.pythoncarsecurity.com/support/guides.aspx.

* cited by examiner

*Primary Examiner*—Tai T Nguyen
(74) *Attorney, Agent, or Firm*—Timothy N. Ellis

(57) ABSTRACT

One aspect of the invention is a system for locating an object. The system may include, for example, an object electromagnetic receiver, an audio amplifier, an audio transducer, and an object microprocessor coupled to the object electromagnetic receiver and the audio amplifier. The object microprocessor is configured to ascertain whether a valid activation signal has been received by the object electromagnetic receiver, and if so, read a digital sound file, and ascertain whether the signal strength of the received valid activation signal is above a first threshold. If the signal strength is not above the first threshold, the object microprocessor outputs a maximum sound level indicator signal; and if the signal strength is above the first threshold, the object microprocessor outputs a second tier sound level indicator signal.

61 Claims, 12 Drawing Sheets

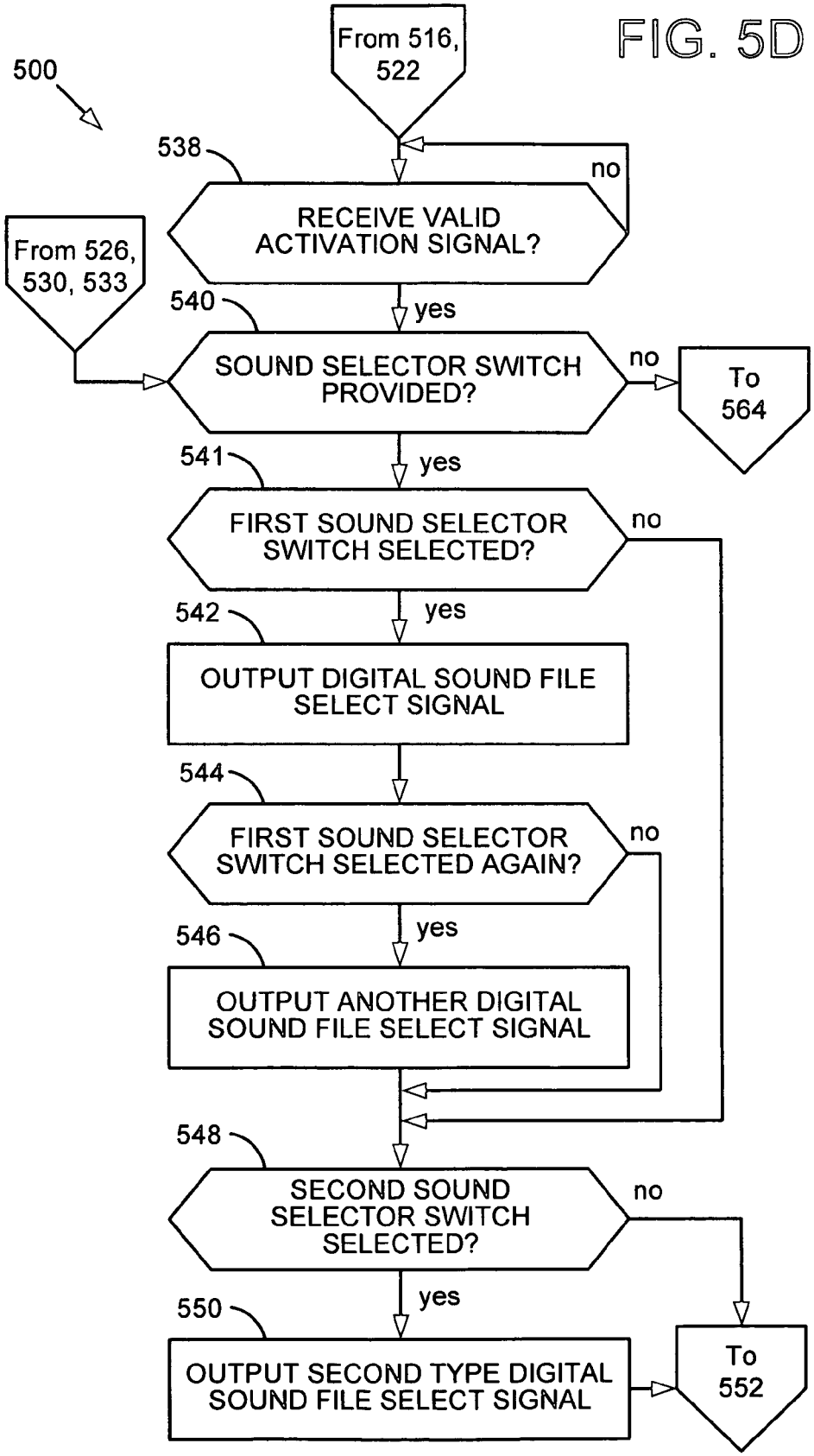
FIG. 5D
500
From 516, 522
538
RECEIVE VALID ACTIVATION SIGNAL?
no
yes
From 526, 530, 533
540
SOUND SELECTOR SWITCH PROVIDED?
no
To 564
yes
541
FIRST SOUND SELECTOR SWITCH SELECTED?
no
yes
542
OUTPUT DIGITAL SOUND FILE SELECT SIGNAL
544
FIRST SOUND SELECTOR SWITCH SELECTED AGAIN?
no
yes
546
OUTPUT ANOTHER DIGITAL SOUND FILE SELECT SIGNAL
548
SECOND SOUND SELECTOR SWITCH SELECTED?
no
yes
550
OUTPUT SECOND TYPE DIGITAL SOUND FILE SELECT SIGNAL
To 552

METHOD AND SYSTEM FOR LOCATING AN OBJECT

BACKGROUND

1. Technical Field

The present invention relates to locating an object. More particularly, the invention concerns methods and systems for locating an object, for example a vehicle in a parking lot.

2. Description of Related Art

Almost everyone that drives a car or truck has had the frustrating experience of leaving a store, movie theater, stadium, or entertainment park, and walking into a large parking lot, and not remembering where they parked their vehicle. Searching for a vehicle in a large parking lot can be time consuming, frustrating, and dangerous. Searching for a vehicle can be particularly dangerous at night, or when the user is accompanied by small children.

Some vehicles are equipped with a small, hand-held remote device, and corresponding circuitry attached to the vehicle, which can be used to lock or unlock the vehicle's doors, to unlock the vehicle's trunk, to activate or deactivate a vehicle security system, or to execute a panic function. The small, hand-held device is sometimes called a "fob". Typically, a fob can be attached to a keychain. The fob and the corresponding circuitry attached to a vehicle, may provide limited assistance when attempting to locate the vehicle. Typically, a fob may have one or more buttons, and when a button on a fob is pressed, the fob emits a radio frequency signal, which may be received by a radio frequency receiver attached to the vehicle. The radio frequency receiver attached to the vehicle may be connected to additional circuitry on the vehicle that performs functions associated with the buttons on the fob. In some instances, pressing a button on a fob will cause a transducer on the vehicle to emit a chirping sound, and/or will cause some lights on the vehicle to briefly illuminate. For example, the panic function may cause the vehicle's horn to sound, and may also cause some exterior lights on the vehicle to flash. Some of the functions may, to a limited extent, help a user locate a vehicle. In this regard, the panic function, or a function that activates the chirping sound, or a function that causes lights to illuminate, may be utilized to provide some assistance when attempting to locate a vehicle.

Some vehicles are equipped with a Global Positioning System (GPS) receiver, which is attached to the vehicle. In some instances the GPS receiver may transmit vehicle location information to a pager or to a wireless telephone (using a data link). These systems report the GPS-determined vehicle location information over commercial pager networks or wireless telephone networks. Operation of these GPS based systems is generally not limited by the distance between the vehicle and the user. A user may use vehicle location information transmitted to a pager or a wireless telephone, to help the user find the vehicle.

Known systems that can be employed to help a user locate a vehicle suffer from several shortcomings. For example, a shortcoming of fob based systems is the limited range of operation. Known fob based systems operate only over short distances, and typically have a maximum operating range of approximately 15 to 46 meters (approximately 50 to 150 feet) between the fob and the vehicle, and consequently are not helpful for locating a vehicle unless the vehicle is already near the fob. Another shortcoming of known fob based systems is that the chirping sound that can be emitted from the vehicle is not loud enough to facilitate locating the vehicle if the user is not already near the vehicle. Another shortcoming of known fob based systems is that, when a panic function is activated, the sound emitted from the vehicle is excessively loud when heard by a user that is near the vehicle. Another shortcoming of known fob based systems is that, when a system is used to cause sound to be emitted from the vehicle, the sound is very similar to the sounds that may be emitted from other vehicles, and this can result in confusion when two or more people are searching for their vehicles in a parking lot at the same time. Another shortcoming of fob based systems is that they generally are expensive.

Known GPS based systems also have a number of shortcomings. One shortcoming is the high cost of obtaining and operating these systems. For example, a user must purchase a costly vehicle mounted GPS system, and hardware for transmitting the GPS location information, and must also purchase a pager or telephone for receiving the GPS location information, and must also subscribe to a paging or wireless telephone service, and must also pay monthly usage fees for the paging or wireless telephone service. Another shortcoming of known GPS based systems is that presenting the GPS data in a useful format, such as a graphical map, requires an expensive smart phone, or a portable computer or Personal Digital Assistant (PDA) that has wireless capability. Another shortcoming of known GPS based systems is the limited location accuracy, which is generally about 30 feet. Another shortcoming of known GPS based systems is that the GPS may not function when the vehicle is located in an enclosed or underground structure.

Another shortcoming of both known fob and GPS based systems is that they typically require expensive, professional installation. In summary, known systems for locating a vehicle are often inadequate.

SUMMARY

One aspect of the invention is a system for locating an object. As an example, the system may include an object electromagnetic receiver, an audio amplifier, an audio transducer coupled to the audio amplifier, and an object microprocessor coupled to the object electromagnetic receiver and the audio amplifier. The object microprocessor may be configured to perform the following operations: ascertaining whether a valid activation signal has been received by the object electromagnetic receiver, and if so: reading a digital sound file, and ascertaining whether the signal strength of the received valid activation signal is above a first threshold. If the signal strength of the received valid activation signal is not above the first threshold, the object microprocessor may also be configured to perform the operation of outputting a maximum sound level indicator signal; and if the signal strength of the received valid activation signal is above the first threshold, the object microprocessor may also be configured to perform the operation of outputting a second tier sound level indicator signal.

Other aspects of the invention are described in the sections below, and include, for example, a method for locating an object.

Various examples of the invention may provide one or more advantages. For example, some examples of the invention advantageously permit locating a vehicle that is a substantial distance from the operator. Some examples of the invention provide the ability to emit sound from the vehicle wherein the loudness level of the sound is a function of the distance from the remote unit (fob) to the vehicle, to permit the user to hear the sound when the remote unit is distant from the vehicle, and to produce sound that is not excessively loud when the remote unit is near the vehicle (which also conserves battery power). Some examples of the invention provide the ability to emit a unique sound from the vehicle, which provides the benefit of eliminating confusion with sounds emitted from other vehicles. Further, the invention generally does not require purchasing additional equipment, does not require a subscription to a pager or wireless telephone service, and generally does not require professional installation. Some examples of the invention also provide a number of other advantages and benefits, which should be apparent from the following description.

BRIEF DESCRIPTION OF THE DRAWINGS

FIGS. 5A-5I are a flowchart of an operational sequence for locating an object in accordance with an example of the invention.

DETAILED DESCRIPTION

The nature, objectives, and advantages of the invention will become more apparent to those skilled in the art after considering the following detailed description in connection with the accompanying drawings.

I. Hardware Components and Interconnections

One aspect of the invention is a system for locating an object. As an example, the object may be a vehicle. Typically, the vehicle may be a car, truck, van, or sports utility vehicle. The vehicle could also be a motorcycle, bicycle, scooter, boat, airplane, helicopter or other type of aircraft. As an example, the user may use the apparatus to find a vehicle that is parked in a large parking lot.

Figure 1:
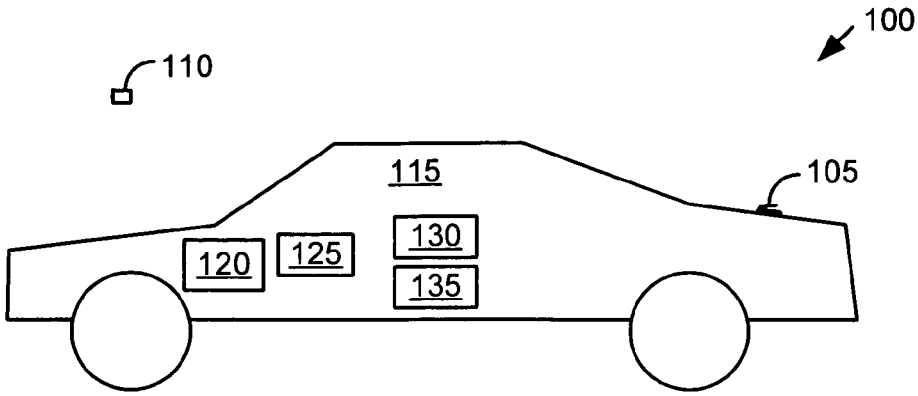
FIG. 1 is a depiction of a system in accordance with an illustrative embodiment of the invention, in its operative environment.

As an example, the invention may be embodied by the system 100 shown in its operative environment in FIG. 1. The system includes an object unit 105 and a remote unit 110. The object unit 105 may also be called a receiver unit. The object unit 105 may be attached to the vehicle 115, or may be located in the vehicle 115 or on the vehicle 115. The remote unit 110 can be carried by the user. The remote unit 110 may also be called a fob. In some examples, the system 100 may be called a car finder, or a long range car finder.

The vehicle 115 may have a vehicle computer 120. The vehicle 115 may also have one or more vehicle property sensors 125. As an example, the vehicle property sensors 125 may include an accelerometer, a motion detector, a vehicle directional orientation sensor, a vehicle temperature sensor, an engine temperature sensor, a sensor for sensing whether lights are on, a sensor for sensing whether doors are locked, a sensor for sensing whether a window is up or down, a sensor for sensing whether the sound system is on, a sensor for sensing whether the engine is on, a sensor for sensing whether the heater is on, a sensor for sensing whether the defroster is on, and a sensor for sensing the air conditioner is on. More than one of any particular type of sensor may be included if desired. The vehicle 115 may also have window controls 130. The vehicle 115 may also have door locks 135.

Figure 2A:
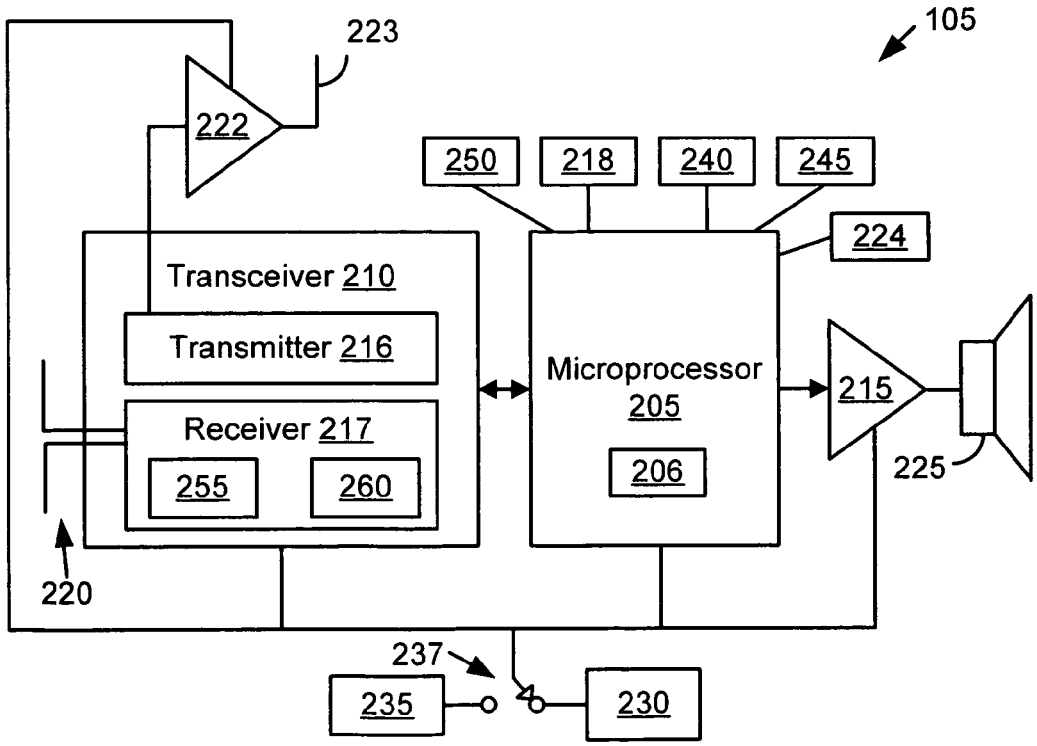
FIG. 2A is a block diagram of the hardware components and interconnections of an object unit in accordance with an example of the invention.

Referring to FIG. 2A, as an example, the object unit 105 may include a microprocessor 205 (which may be called an object microprocessor), and a transceiver 210 (which may be called a data transceiver or an object transceiver). The object microprocessor 205 may include an internal memory 206. As an example, the internal memory 206 could include RAM, ROM, flash memory, an EPROM and/or an EEPROM, etc. Herein the word "microprocessor" includes microprocessors, microcontrollers, digital signal processors, application specific integrated circuits (ASICs), logic arrays, and any other suitable digital data processing apparatus, and may include one or more integrated circuits and/or discrete circuit components. The transceiver 210 may be an electromagnetic transceiver, and in some examples, may be an RF transceiver. The transceiver 210 may be a single integrated circuit that includes both a transmitter 216 and a receiver 217. The transmitter 216 may be called an object transmitter, and may be an RF transmitter, and the receiver 217 may be called an object receiver, and may be an RF receiver. In some examples a receiver (which may be an RF receiver) and a transmitter (which may be an RF transmitter), which are discrete from each other, could be used instead of the transceiver 210. In some other examples, only a receiver (which may be an RF receiver), could be used in place of the transceiver 210. The object unit 105 may also include an audio power amplifier 215, and a memory 218 that is external from the microprocessor, which are coupled to the microprocessor 205. As an example, the memory 218 could include RAM, ROM, flash memory, an EPROM and/or an EEPROM, etc. In some examples the memory 218 could include a hard disk drive and/or an optical disc drive. In some examples the audio power amplifier is called an audio amplifier. The audio amplifier is any amplifier that can drive an audio transducer. In some examples, the memory 218 is not included, the memory 206 in the object microprocessor 205 is utilized rather than the external memory 218. In other examples, both the external memory 218, and the memory 206 in the object microprocessor 205 are utilized. The object unit 105 also may include a dipole antenna 220, which is coupled to the transceiver 210. In other examples, other types of antennas could be used. A vertically oriented dipole antenna 220 on the object unit 105 reduces sensitivity to the mounting location of the object unit 105, and extends the operating range, thereby minimizing the transmit power required from the remote unit 110. The object unit 105 may also include a power amplifier 222 (which may be an RF power amplifier) coupled to the transceiver 210, and a transmitting antenna 223 coupled to the power amplifier 222. The object unit 105 may also include a plurality of switches 224, which may be used to identify a digital sound file (which is discussed below). As an example, the plurality of switches may be four DIP switches, but could be any number of switches. The object unit 105 may also include a speaker 225, which is coupled to the audio power amplifier 215. Many different types of transducers, for example, a horn, a loudspeaker, or a piezoelectric transducer, could be employed as the speaker 225. In some examples, an FET switch could be used to activate a horn, which could be employed as the speaker 225. The object unit 105 may also include a battery 230 which may be independent from the vehicle power. The object unit 105 may also include a vehicle power interface 235. The object unit 105 may also include a switch 237, which permits selecting either the battery 230 or the vehicle power interface 235 for providing power. The battery 230 or the vehicle power interface 235 may be coupled to the microprocessor 205, the transceiver 210, the audio power amplifier 215, and the power amplifier 222. If the battery 230 is a rechargeable battery, the vehicle power interface 235 may be coupled to the battery 230 to charge the battery 230. The object unit 105 may also include a USB port 240, coupled to the microprocessor 205, for inputting (and in some examples outputting) information to the object unit 105, for example, digital sound files (which may represent sounds called tones or alarms) or firmware updates. The object unit 105 may also include a wireless communications port 245, coupled to the microprocessor 205, for inputting (and in some examples outputting) information to the object unit 105, for example, digital sound files or firmware updates. The object unit 105 may also include a vehicle systems interface 250, coupled to the microprocessor 205. The receiver 217 may include a plurality of logarithmic detectors 255, coupled to respective amplifier stages in a plurality of amplifier stages 260.

Figure 2B:
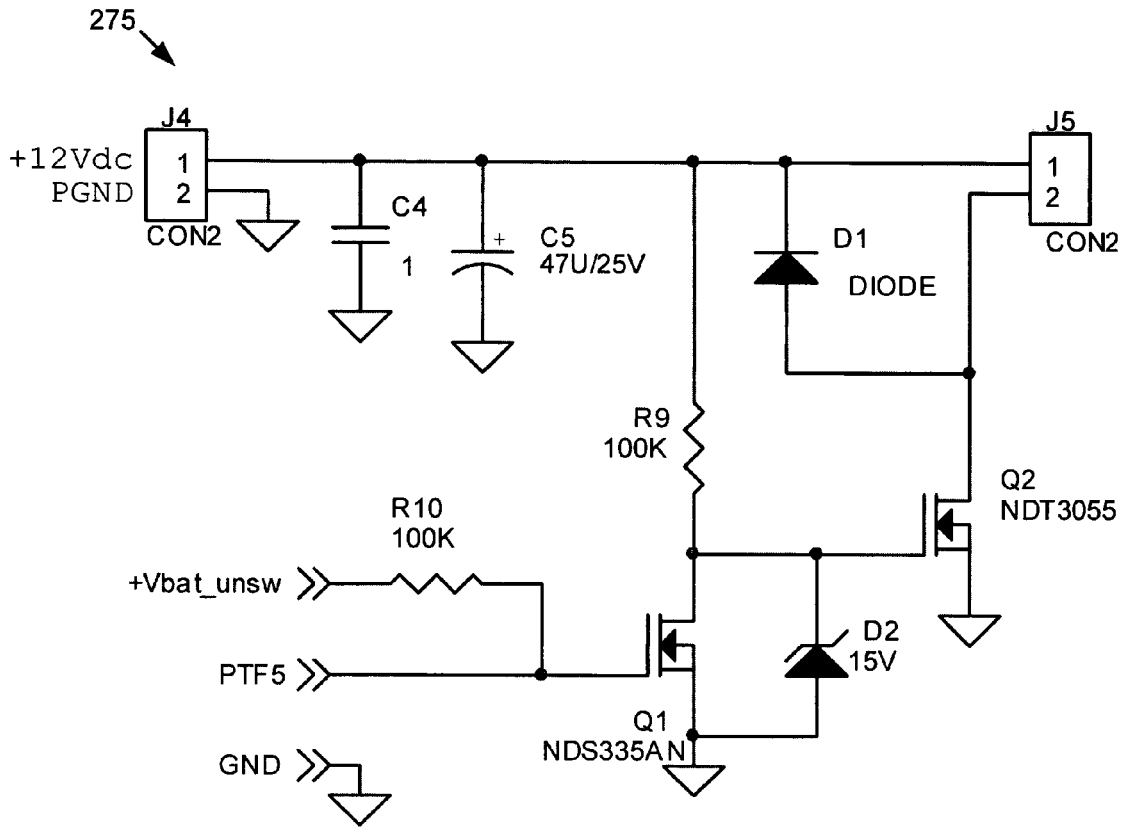
FIG. 2B is a block diagram of the hardware components and interconnections of a circuit for interfacing with a horn.

In some examples, the speaker 225 may be a horn. FIG. 2B shows an exemplary circuit 275 for interfacing to a horn. The circuit 275 includes connectors J4 and J5, capacitors C4 and C5, resistors R9 and R10, transistors Q1 and Q2, diode D1, and zener diode D2. The circuit 275 interfaces to an unswitched voltage "+Vbat_unsw", to an I/O pin on the microprocessor 205 "PTF5" (for turning the horn on and off), to ground "GND", to +12 volts "+12Vdc", and to a power ground "PGND". The outputs to the horn are pins 1 (+) and 2 (−) of connector J5.

Figure 3:
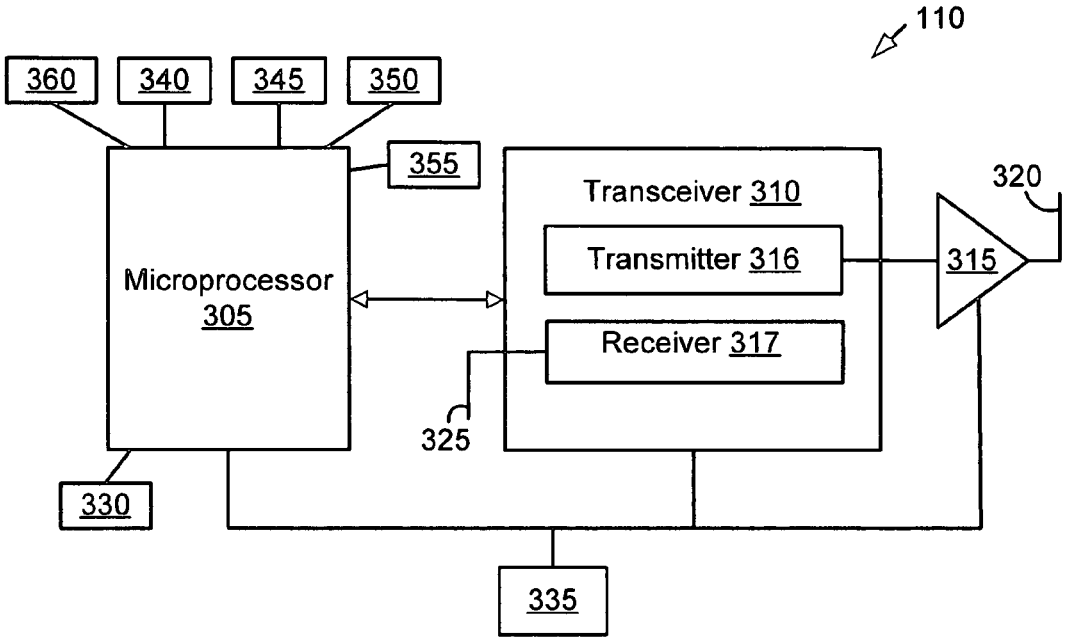
FIG. 3 is a block diagram of the hardware components and interconnections of a remote unit in accordance with an example of the invention.

Referring to FIG. 3, as an example, the remote unit 110 may include a microprocessor 305 (which may also be called a remote microprocessor), and a transceiver 310 (which may be called a data transceiver or a remote transceiver), and which may be an electromagnetic transceiver. In some examples, the transceiver 310 may be an RF transceiver. The transceiver 310 includes a transmitter 316, which may be called a remote transmitter, and which may be an RF transmitter, and a receiver 317, which may be called a remote receiver, and which may be an RF receiver. In some examples a receiver (which may be an RF receiver) and a transmitter (which may be an RF transmitter), which are discrete from each other, could be used instead of the transceiver 310. In some other examples, only a transmitter (which may be an RF transmitter) could be used in place of the transceiver 310. The remote unit 110 may also include a power amplifier 315 (which may be called a remote power amplifier, and which may be an RF power amplifier), which is coupled to the transmitter 316 in the transceiver 310. The remote unit 110 may also include an antenna 320 coupled to the power amplifier 315. The antenna 320 may be selectably extendable from the remote unit 110, to extend the operational range of the system 100. The remote unit 110 may also include a receive antenna 325, which is coupled to the receiver 317 in the transceiver 310. The remote unit 110 may also include an LED 330, which is coupled to the microprocessor 305. As an example, the LED 330 may be employed as a low battery power indicator (discussed below). In other examples, more than one LED may be used. The remote unit 110 may also include a battery 335, which is coupled to the microprocessor 305, the transceiver 310, and the power amplifier 315.

The remote unit 110 may include one or more switches, which are coupled to the microprocessor 305. For example, a transmit switch 340, a high transmit power level switch 345, a first sound selector switch 350, a second sound selector switch 355, and/or a transmit repeat selection switch 360 may be included. As an example, the transmit switch 340 may be a momentary contact switch (normally open or normally closed), the high transmit power level switch 345 may be a momentary contact switch (normally open or normally closed), or a single pole single throw switch, or a single pole double throw switch. As an example, the transmit repeat selection switch 360 may be a momentary contact switch (normally open or normally closed), or a single pole single throw switch. As an example, the first sound selector switch 350 and the second sound selector switch 355 may each be a momentary contact switch (normally open or normally closed), or a single pole single throw switch, or a single pole double throw switch. In some examples, the first sound selector switch 350 and the second sound selector switch 355 could be implemented with one single pole double throw switch, wherein the first sound is selected when the switch is in a first position, and the second sound is selected when the switch is in a second position. Buttons may be attached to the switches.

Figure 4:
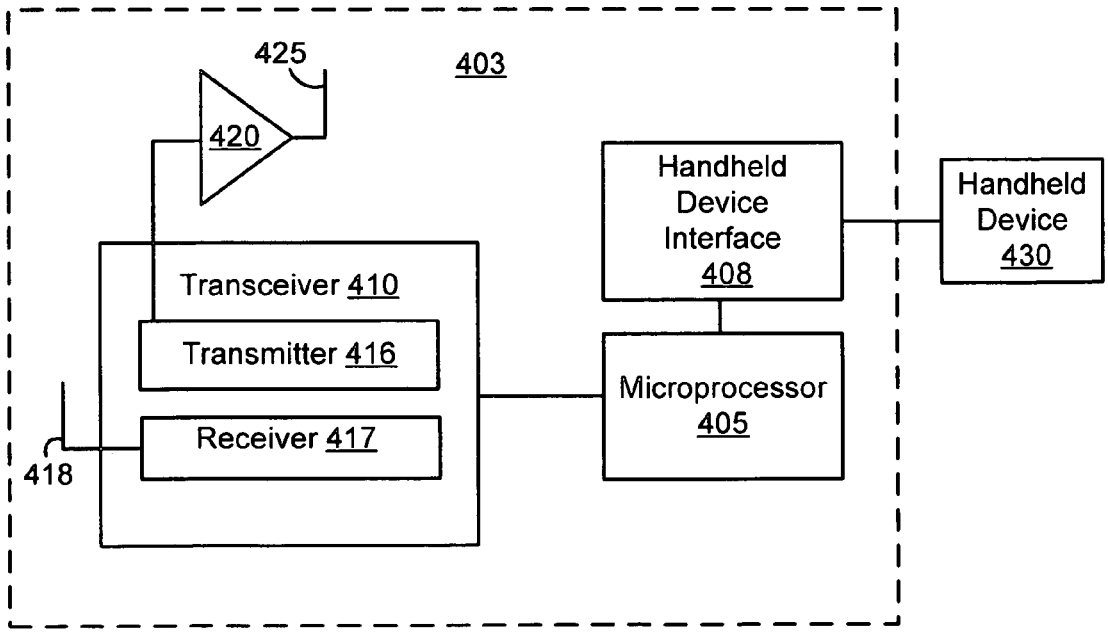
FIG. 4 is a block diagram of the hardware components and interconnections of a handheld device interface unit in accordance with an example of the invention.
Figure 5A:
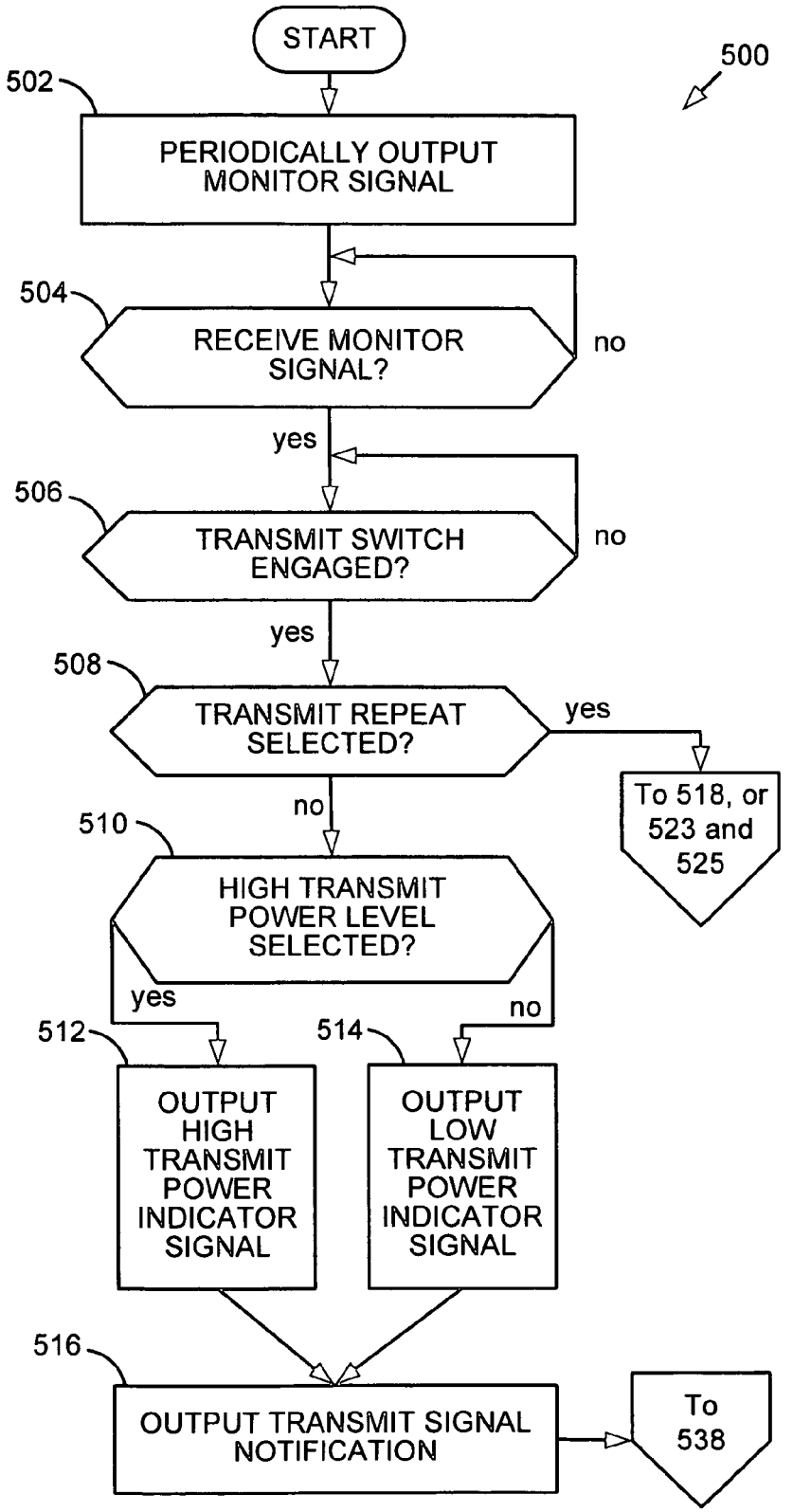
Figure 5B:
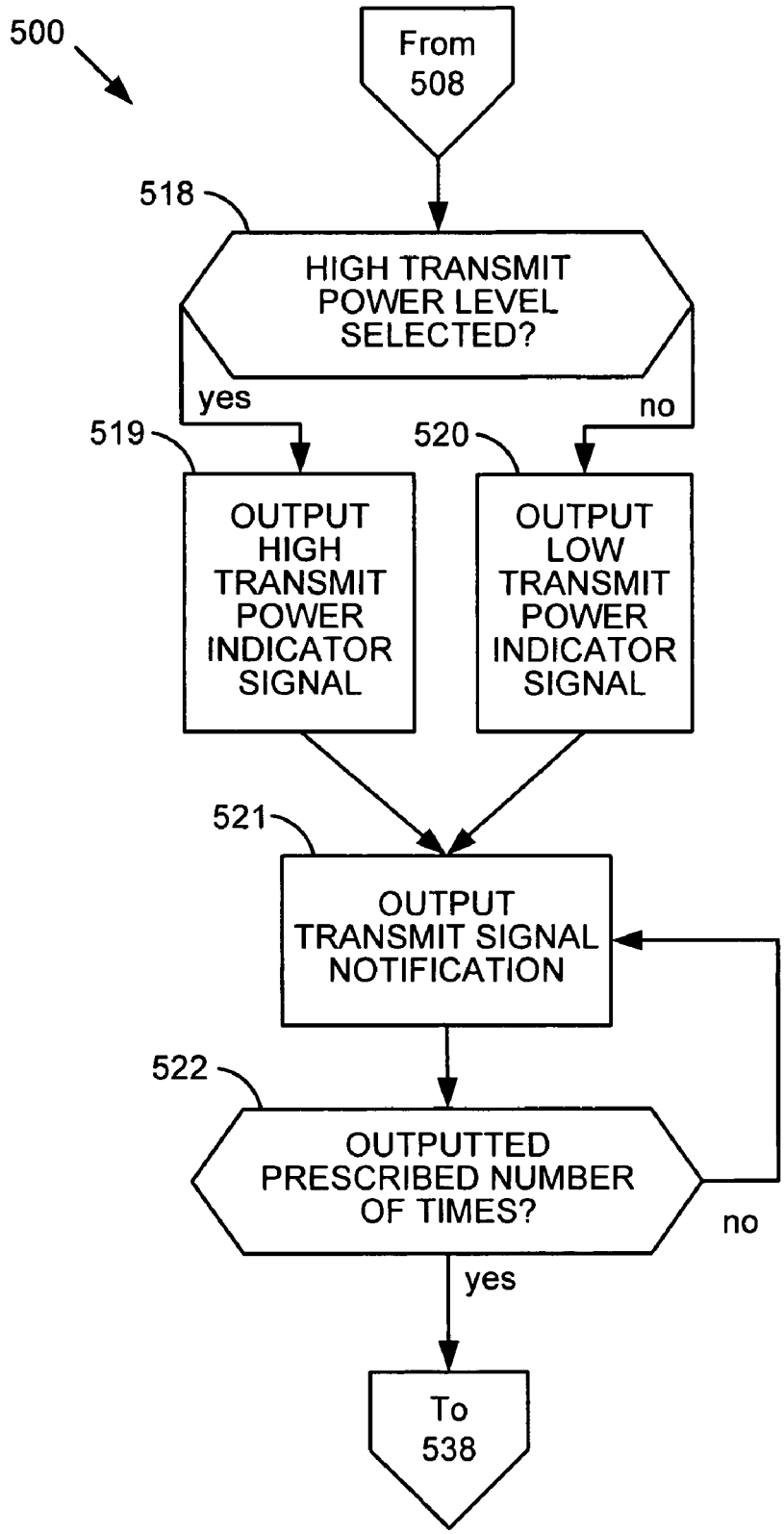
Figure 5C:
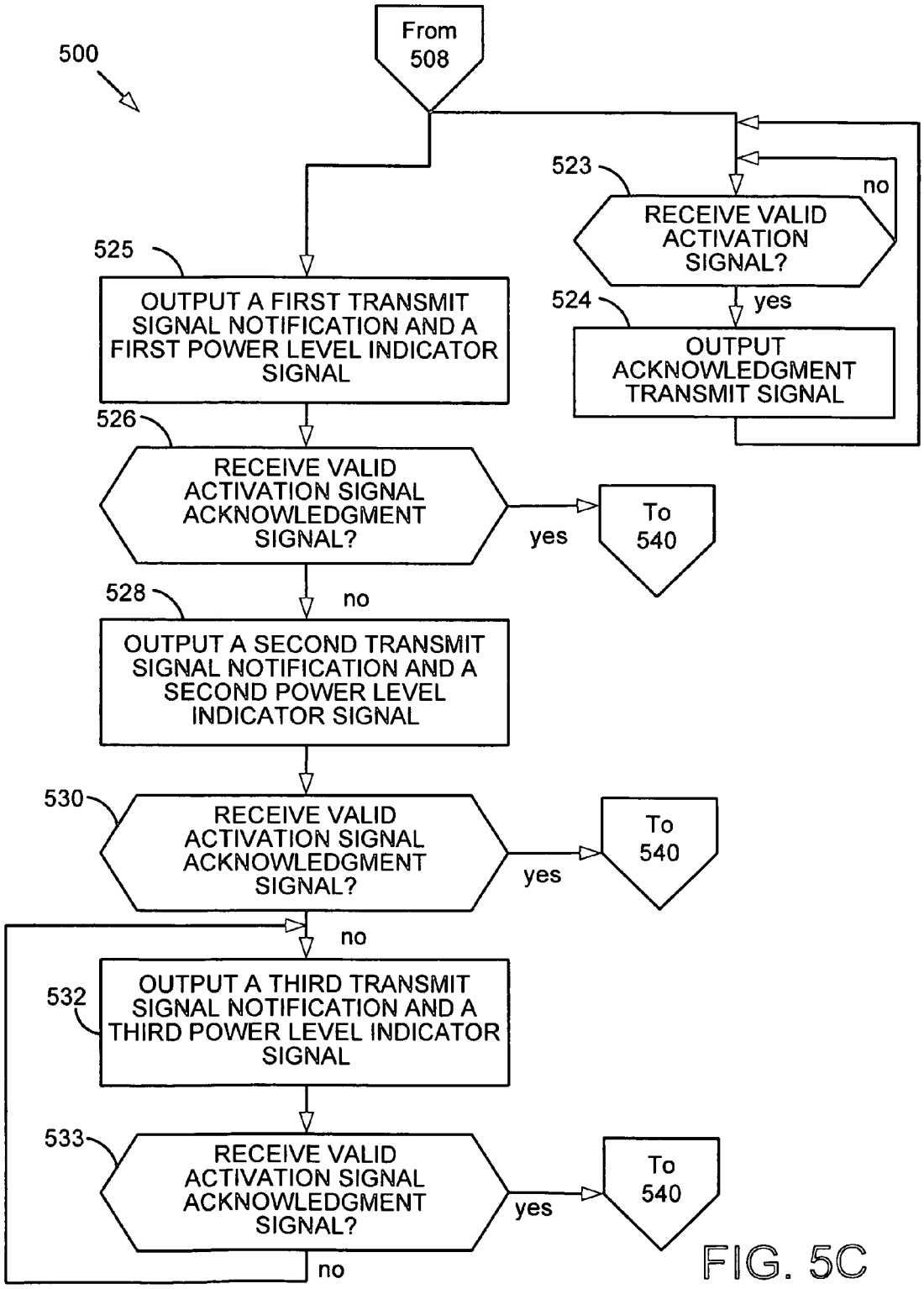
Figure 5E:
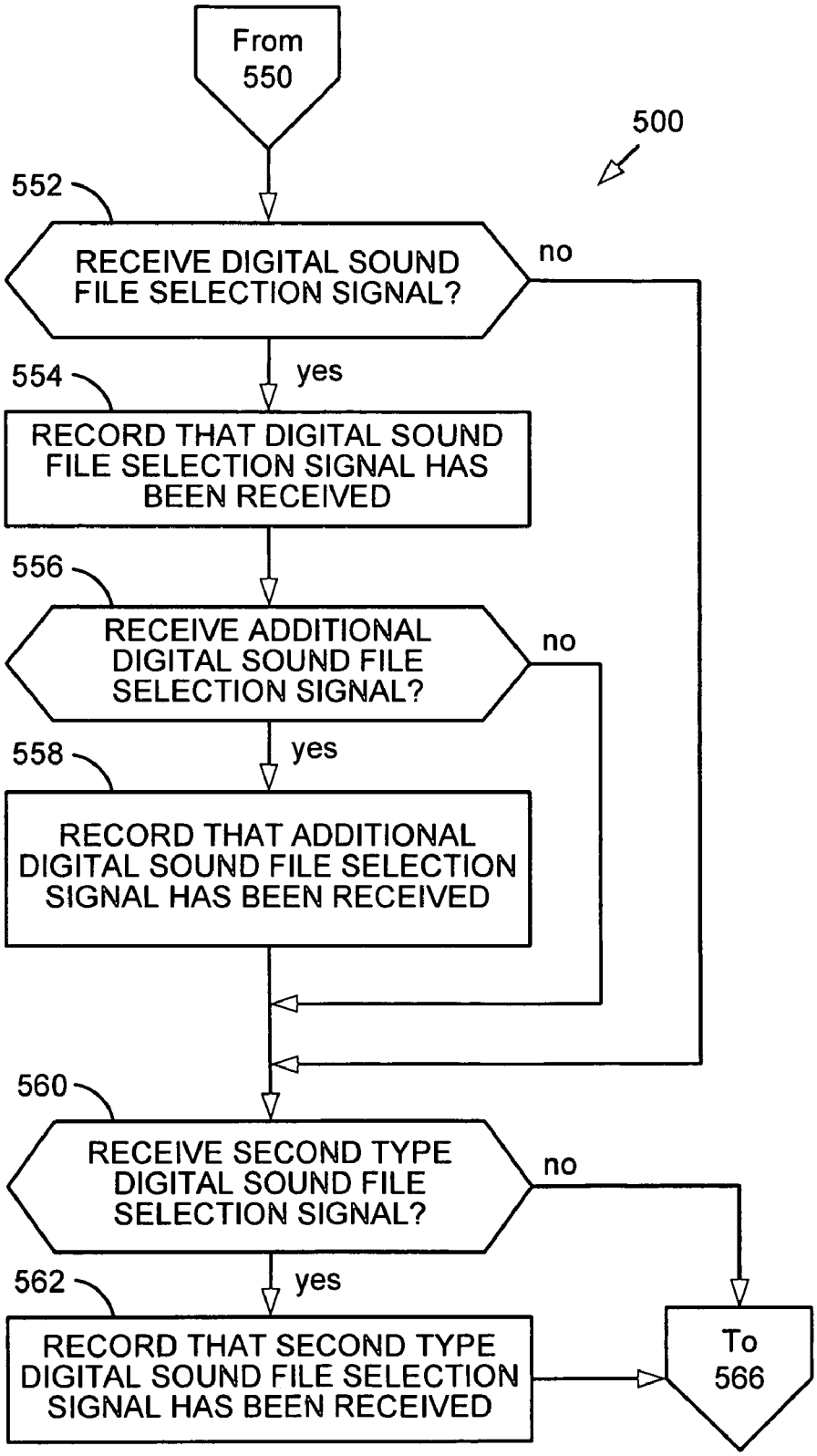
Figure 5F:
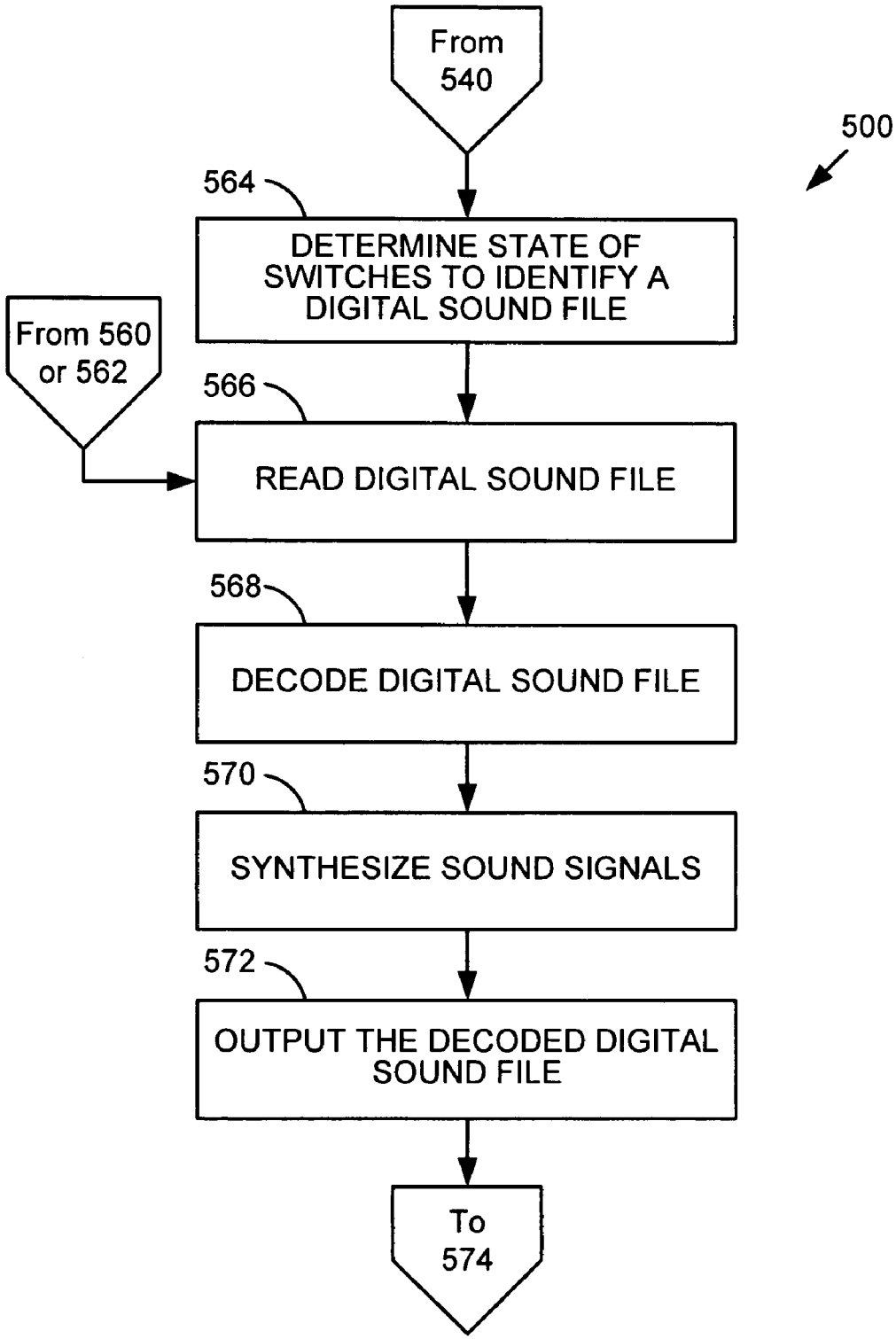
Figure 5G:
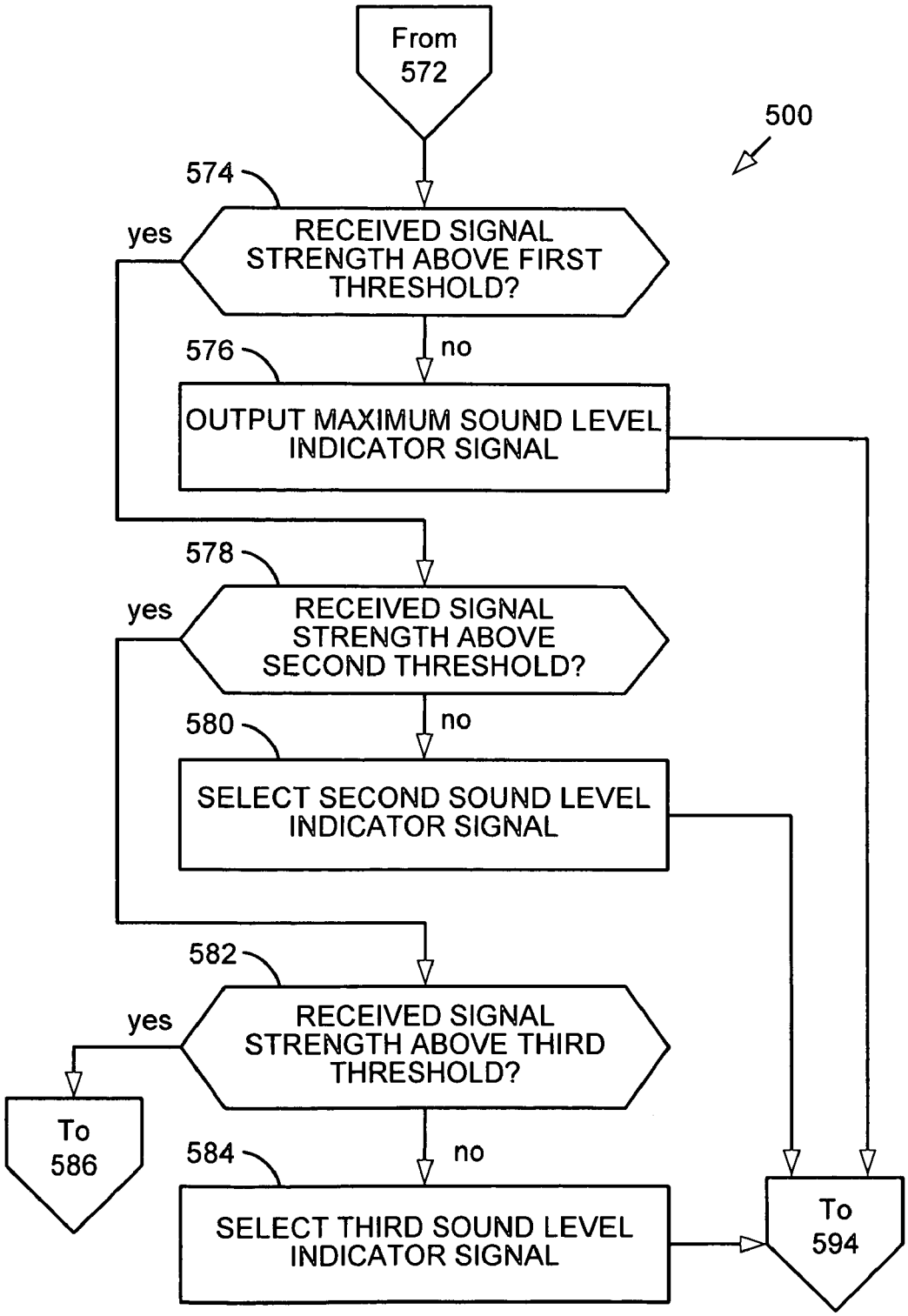
Figure 5H:
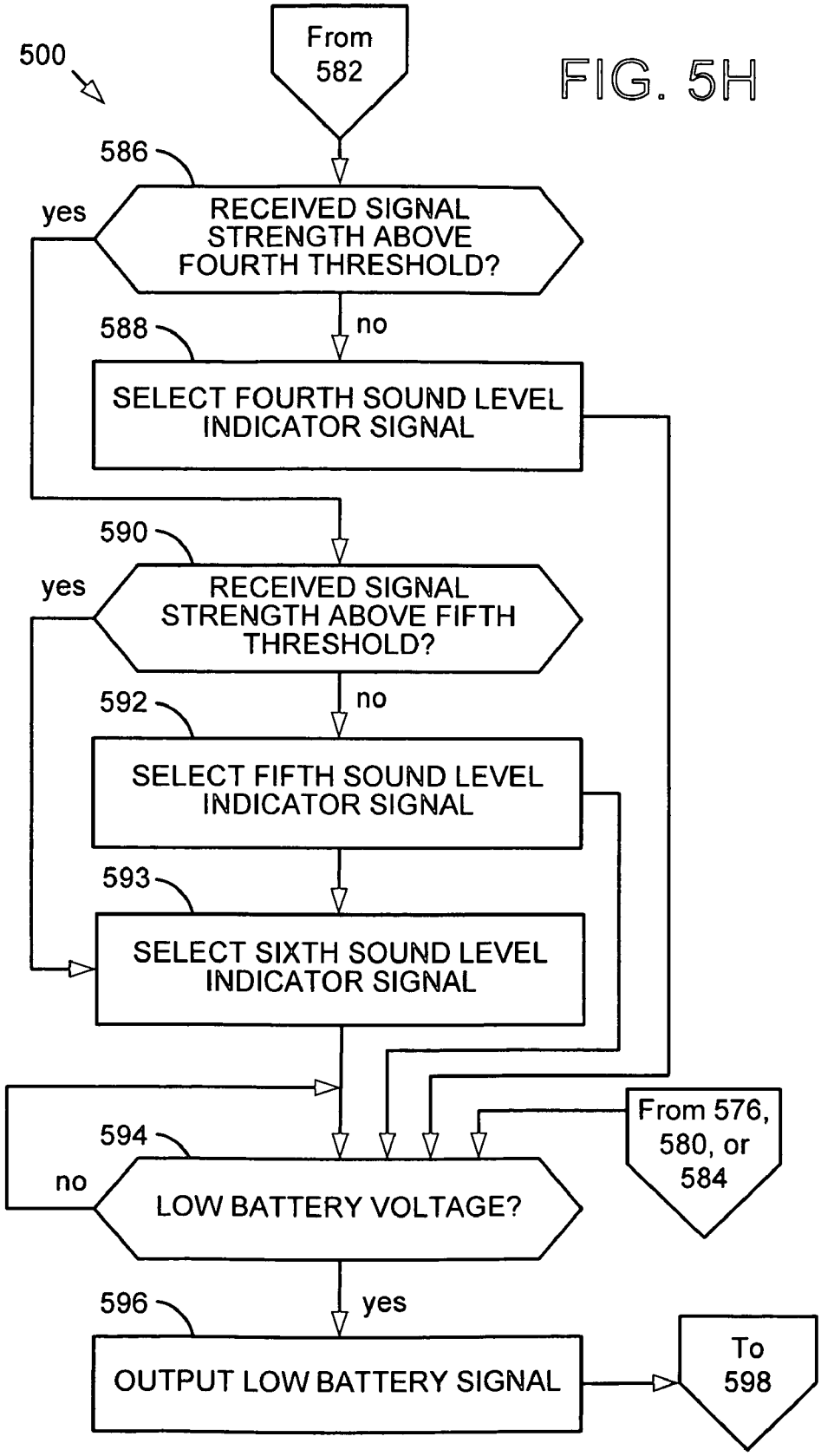
Figure 5I:
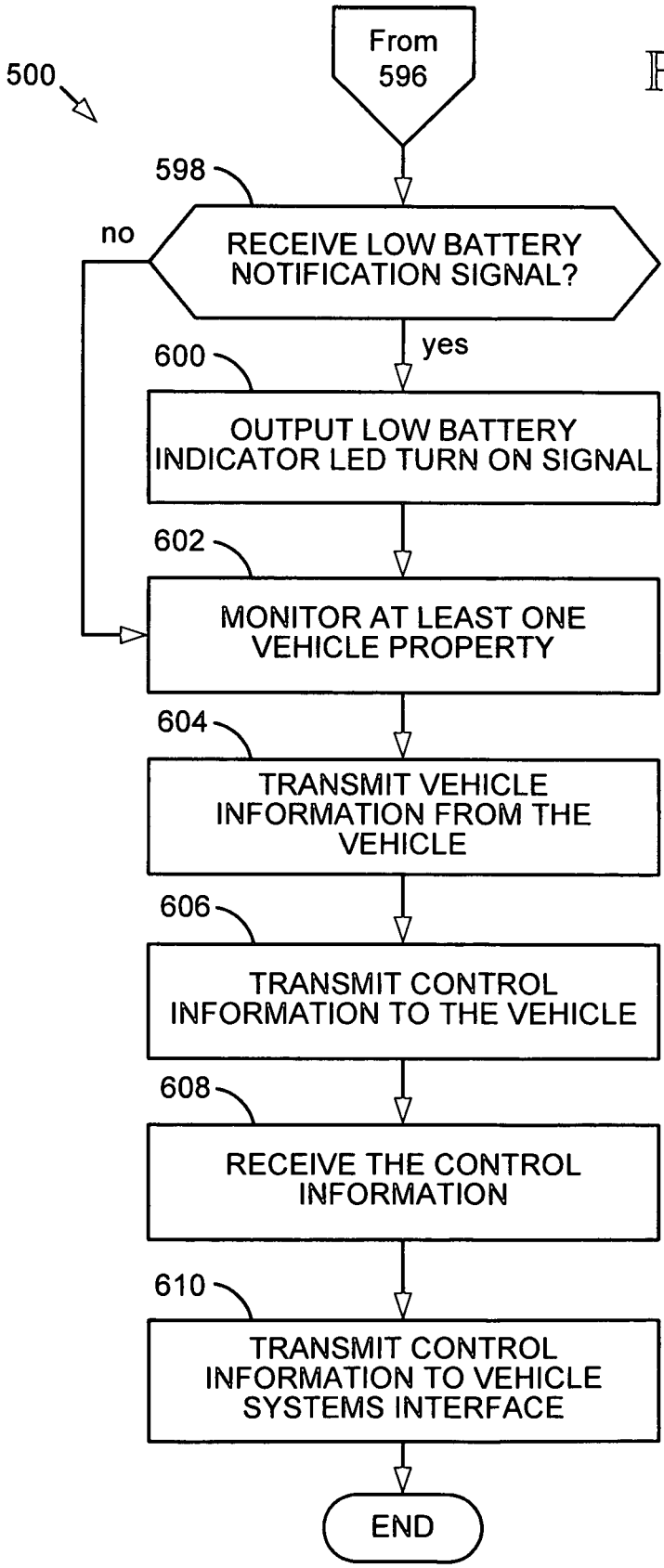

Referring to FIG. 4, some examples of the invention include components for interfacing with a handheld device 430, such as a mobile telephone, a personal digital assistant (PDA), a handheld computer, a laptop computer, or other type of portable computing device. Accordingly, some examples may include a handheld device interface unit 403, which may include a microprocessor 405, which is coupled to a handheld device interface 408, and to a transceiver 410. The transceiver 410 may be an electromagnetic transceiver, and in some examples, may be an RF transceiver (which may be called an RF data transceiver). The transceiver 410 includes a transmitter 416, which may be an RF transmitter, and a receiver 417 which may be an RF receiver. In some examples a receiver (which may be an RF receiver) and a transmitter (which may be an RF transmitter), which are discrete from each other, are used instead of the transceiver 410. In some other examples, only a transmitter (which may be an RF transmitter) is used in place of the transceiver 410. An antenna 418 may be coupled to the receiver 417. A power amplifier 420 (which may be an RF power amplifier) may be coupled to the transmitter 416, and an antenna 425 may be coupled to the power amplifier 420.

The receivers 217, 317, 417 the transmitters 216, 316, 416 and the power amplifiers 222, 315, 420 coupled to the transmitters 216, 316, 416, shown in FIGS. 2-4 may more generally be called electromagnetic receivers, transmitters, and power amplifiers. In many examples the receivers 217, 317, 417 the transmitters 216, 316, 416 and the power amplifiers 222, 315, 420 will operate at RF frequencies. In some other examples the receivers 217, 317, 417 the transmitters 216, 316, 416 and the power amplifiers 222, 315, 420 could operate at other electromagnetic frequencies than RF electromagnetic frequencies.

In some examples, the receivers 217, 317, 417 and the transmitters 216, 316, 416, utilize spread spectrum electromagnetic communications in UHF ISM bands. As an example, 915 MHz could be used for transmissions within the ISM bands. However, other frequencies could be used. The system 100 may be configured to meet FCC part 15 requirements for unlicensed spread-spectrum operation, with transmit power up to 1 Watt (but in other examples greater power could be used). In some embodiments, the receivers 217, 317, 417 and the transmitters 216, 316, 416, implement spread-spectrum transmission and reception using wide-deviation frequency shift keying (FSK), which permits utilizing simplified transmit and receive circuits compared to direct-sequence (DS) or frequency-hopping (FH) spread-spectrum techniques. This reduces hardware costs, and reduces the complexity of programming and operating the system. Wide-deviation FSK spread-spectrum provides immunity from interference in the receiver, which is better than narrow band FSK, but that is not as good as DS or FH techniques. However, in other examples, DS or FH spread-spectrum techniques could be used.

As an example, the transceiver 210 and the transceiver 310 and the transceiver 410 may each be an Analog Devices Digital Modulation ISM Band Transceiver IC (for example, model number ADF7025). As an example, the microprocessor 205 and the microprocessor 305 and the microprocessor 405 may be implemented with a microprocessor or a microcontroller, and in a specific example, each may be a Freescale 68HC08 family single-chip, flash-based microcontroller (for example, model number 9S08 GB60). However, the microprocessor 205 and the microprocessor 305 and the microprocessor 405 need not be implemented with the same make or model of microprocessor or controller. The Analog Devices ADF7025 transceiver has no internal non-volatile memory to hold its configuration settings, and consequently, it is programmed to its desired configuration each time it is powered up. As an example, the microprocessor 205 or 305 or 405 may program the respective transceiver 210, 310, 410 through an industry standard 3-wire Serial Peripheral Interface (SPI). Registers in the transceivers 210, 310, 410 may be loaded by the corresponding microprocessors 205, 305,405 in a manner specified for the transceivers 210, 310, 410 (for example, the order in which registers are loaded, and the timing delays between loads). In addition to the Serial Peripheral Interface (SPI), there may be a dedicated interface for sending application data between the microprocessors 205, 305, 405 and the corresponding transceivers 210, 310, 410. A general-purpose I/O pin on the microprocessors 205, 305, 405 may be connected to a specific data pin on the corresponding transceiver 210, 310, 410 for sending and receiving data. In some examples, a general-purpose I/O pin on the microprocessor 205 in the object unit 105 may be configured as an output for activating the audio power amplifier 215.

II. Operation

In addition to the various hardware embodiments described above, a different aspect of the invention concerns a method for locating an object.

Overall Sequence of Operation

An example of the method aspect of the present invention is illustrated in FIGS. 5A-I, which show a sequence 500 for a method for locating an object. For ease of explanation, but without any intended limitation, the example of FIGS. 5A-I is described in the context of the system 100 described above. For many examples of the invention, only a subset of the operations of the sequence 500 are included.

The sequence 500 may begin with operation 502, which may be performed by the object microprocessor 205, and which comprises periodically outputting a monitor signal to instruct the object transmitter 216 to periodically transmit a monitor indication signal. Operation 504, which may be performed by the remote microprocessor 305, comprises determining if the remote receiver 317 has received the monitor indication signal. If the monitor indication signal has not been received, operation 504 may be repeated. Operation 506, which may be performed by the remote microprocessor 305, comprises determining if the transmit switch 340 has been engaged. Operation 506 may be repeated if the transmit switch 340 has not been engaged. As an example, the transmit switch 340 may be engaged by pressing a momentary contact switch to momentarily connect (or alternatively, to momentarily disconnect) the contacts of the transmit switch 340. In other embodiments, the transmit switch 340 could be engaged by closing (or opening) the circuit of a single pole single throw switch (or half of a single pole double throw switch). If the remote microprocessor 305 determines that the transmit switch 340 has been engaged, and in some examples, if the remote microprocessor 305 also determines that the monitor indication signal has been received, then the remote microprocessor 305 may perform operation 508, which is discussed below.

In some alternative embodiments, operation 504 may be performed by the microprocessor 405 of the handheld device interface unit 403 (shown in FIG. 4), and if so operation 504 comprises determining if the receiver 417 in the handheld device interface unit 403 has received the monitor indication signal. Also, in some alternative embodiments, operation 506 comprises determining if a transmit signal is received by the microprocessor 405 from the handheld device interface 408, for example if a button on the handheld device 430 which functions as a transmit switch is pressed. If the microprocessor 405 receives a transmit signal from the handheld device interface 408, and, in some examples, if the microprocessor 405 also determines that the monitor indication signal has been received by the receiver 417, then the microprocessor 405 may perform operation 508, which is discussed below.

In some examples, the object microprocessor 205 does not output a monitor signal, and the remote microprocessor 305 (alternatively, the microprocessor 405 in the handheld device interface unit 403) does not determine if the remote receiver 317 (alternatively, the receiver 417) has received the monitor indication signal, and in these other examples, if the remote microprocessor 305 determines that the transmit switch 340 has been engaged (alternatively, if the microprocessor 405 determines that the transmit signal has been received from the handheld device interface 408), then operation 508 may be performed.

Operation 508 may be performed in examples wherein the remote unit 110 includes a transmit repeat selection switch 360 (or in alternative examples wherein the handheld device interface unit 403 is configured such that a button on the handheld device 430 functions as a transmit repeat selection switch). Operation 508, which may be performed by the remote microprocessor 305 in the remote unit 110 (or alternatively by the microprocessor 405 in the handheld device interface unit 403), comprises ascertaining whether the transmit repeat selection switch 360 has been moved to a select position (or alternatively, whether a transmit repeat selection switch on the handheld device 430 has been moved to a select position). If it is ascertained that the transmit repeat selection switch 360 has been moved to a select position, then operation 518 (discussed below), or operations 523 and 525 (discussed below) may be performed. If it is ascertained that the transmit repeat selection switch 360 has not been moved to a select position, then operation 510 (discussed below) may be performed. In examples wherein a transmit repeat selection switch 360 is not included (and in examples where the handheld device interface unit 403 does not provide functionality for a transmit repeat selection switch), then the sequence 500 may continue with operation 510 (discussed below). Placing the transmit repeat selection switch 360 in a select position may be called putting the remote unit 110 in a search mode. In some examples, a beep or a series of beeps, or another sound (which could be emitted from a transducer that could be coupled to the microprocessor 305), could be emitted from the remote unit 110 when the remote unit 110 is in the search mode. In some examples, the transmit repeat selection switch 360 may be a momentary contact switch, which may be moved to a select position by momentarily pressing the switch to momentarily connect (or alternatively, to momentarily disconnect) the contacts of the switch. In other examples, the transmit repeat selection switch 360 may be a single pole single throw switch, or a single pole double throw switch, which may be switched to a select position or to a non-select position.

In some examples, the remote unit 110 includes a high transmit power level switch 345. In alternative examples, the handheld device interface 408 may be configured so a button on the handheld device 430 functions as a high transmit power level switch. In examples wherein a high transmit power level switch 345 is not included (and in examples where the handheld device interface unit 403 does not provide functionality for a high transmit power level switch), then the sequence 500 may continue with operation 516 (discussed below). If in operation 508, it is ascertained that the transmit repeat selection switch 360 has not been moved to a select position (or alternatively, that a transmit repeat selection switch on the handheld device 430 has not been moved to a select position), then, in examples wherein a high transmit power level switch 345 is included (or in examples wherein a button on the handheld device 430 functions as a power level switch), one or more of operations 510-516 may be performed. Operations 510-516 may be performed, for example by the remote microprocessor 305 (or alternatively, by the microprocessor 405 in the handheld device interface unit 403). Operation 510 comprises ascertaining whether the high transmit power level switch 345 has been moved to a select position (or alternatively, whether a button functioning as a high transmit power level switch on the handheld device 430 has been engaged). In some examples the high transmit power level switch 345 may be a momentary contact switch, which may be moved to a select position by momentarily pressing the switch, to momentarily connect (or alternatively, to momentarily disconnect) the contacts of the switch. In other examples, the high transmit power level switch 345 may be a single pole single throw switch, or a single pole double throw switch, which may be switched to a select position or to a non-select position. If the high transmit power level switch 345 has been moved to a select position (or alternatively, if a high transmit power level switch on the handheld device 430 has been engaged), operation 512 may be performed, which comprises outputting a high transmit power indicator signal from the remote microprocessor 305 (or the microprocessor 405) to instruct the remote transmitter 316 (or the transmitter 416) to output a valid activation signal at a primary transmit power level, when the remote transmitter 316 (or the transmitter 416) receives a transmit signal notification (discussed below with regard to operation 516). If the high transmit power level switch 345 has not been moved to a select position (or alternatively, if a high transmit power level switch on the handheld device 430 has not been engaged), operation 514 may be performed, which comprises outputting a low transmit power indicator signal from the remote microprocessor 305 (or the microprocessor 405) to instruct the remote transmitter 316 (or the transmitter 416) to output a valid activation signal at a secondary transmit power level that is lower than the primary transmit power level, when the remote transmitter 316 (or the transmitter 416), receives a transmit signal notification. After either operation 512 or operation 514, operation 516 may be performed. Operation 516 comprises outputting, from the microprocessor 305 (or the microprocessor 405), a transmit signal notification, to instruct the remote transmitter 316 (or alternatively, the transmitter 416) to output a valid activation signal, at a high power level or a low power level, depending on whether operation 512 or operation 514 is performed. In examples wherein a high transmit power level switch 345 is not included (and in examples where the handheld device interface unit 403 does not provide functionality for a high transmit power level switch, operation 516 may comprise outputting a valid activation signal at a default power level, which, for example, may be a high power level. In some examples, operation 516 may be performed after operation 512 or 514 is performed.

If, in operation 508 (discussed above), the remote microprocessor 305 (or the microprocessor 405 in the handheld device interface unit 403) ascertains that the transmit repeat selection switch 360 (or a button in the handheld device 430 which operates as a transmit repeat selection switch) has been moved to the select position, and if a high transmit power level switch 345 is included (or in examples where the handheld device interface unit 403 provides functionality for a high transmit power level switch), then one or more of operations 518-522 may be performed. Operation 518 comprises ascertaining whether the high transmit power level switch 345 has been moved to a select position (or alternatively, whether a button functioning as a high transmit power level switch on the handheld device 430 has been engaged). If the high transmit power level switch 345 has been moved to a select position (or alternatively, if a button functioning as a high transmit power level switch on the handheld device 430 has been engaged), operation 519 may be performed, which comprises outputting a high transmit power indicator signal from the remote microprocessor 305 (or the microprocessor 405) to instruct the remote transmitter 316 (or the transmitter 416) to output a valid activation signal at a primary transmit power level, when the remote transmitter 316 (or the transmitter 416) receives a transmit signal notification. If the high transmit power level switch 345 has not been moved to a select position (or alternatively, if a button functioning as a high transmit power level switch on the handheld device 430 has not been engaged), operation 520 may be performed. Operation 520 comprises outputting a low transmit power indicator signal from the remote microprocessor 305 (or the microprocessor 405) to instruct the remote transmitter 316 (or the transmitter 416) to output a valid activation signal at a secondary transmit power level that is lower than the primary transmit power level, when the remote transmitter 316 (or the transmitter 416), receives a transmit signal notification. In examples wherein one or more of operations 518-520 are performed, after either operation 519 or operation 520 is performed, operation 521 may be performed. Operation 521 comprises outputting a transmit signal notification, to instruct the remote transmitter 316 (or alternatively, the transmitter 416) to output a valid activation signal, and if either operation 519 or operation 520 is performed, then operation 521 further comprises instructing the remote transmitter 316 (or alternatively, the transmitter 416) to output the valid activation signal at a high power level or a low power level, depending on whether operation 519 or operation 520 is performed. Operation 522 comprises determining if the transmit signal notification has been outputted a prescribed maximum number of times, and if not, operation 521 may be repeated, and if so, the outputting of the transmit signal notification may be terminated.

In examples wherein in operation 508 (discussed above), the remote microprocessor 305 (or the microprocessor 405 in the handheld device interface unit 403) ascertains that the transmit repeat selection switch 360 (or a button in the handheld device 430 configured to operate as a transmit repeat selection switch) has been moved to the select position, and if a high transmit power level switch 345 is not included (and in examples where the handheld device interface unit 403 does not provide functionality for a high transmit power level switch in the handheld device 430), then operations 521 and 522 may be performed without performing any of operations 518-520.

In some other examples, if the transmit repeat selection switch 360 (or a button in a handheld device 430 configured to operate as a transmit repeat selection switch) has been moved to the select position in operation 508, instead of performing one or more of operations 518-522, one or more of operations 525-533 may be performed by the remote microprocessor 305 (or the microprocessor 405), and operations 523 and 524 may be performed by the object microprocessor 205. Operation 523, which may be performed by the object microprocessor 205, comprises ascertaining whether a valid activation signal has been received by the object receiver 217. Operation 523 may be repeated, and the object microprocessor 205 may perform operation 523 whenever the object unit 105 is operating. The valid activation signal may include an identification security code, and in that case, the operation of ascertaining whether a valid activation signal has been received includes ascertaining whether the identification security code is valid. A unique ID code may be provided for each object unit 105—remote unit 110 pair (or for each object unit 105—handheld device interface unit 403 pair), to provide security for each pair. In some examples, all messages transmitted between the object unit 105 and the remote unit 110 (or the handheld device interface unit 403) could use AES-128 encryption (for example, in software) to enhance the privacy and integrity of transmitted messages. A fixed key coupled to a previously established unique ID code could be used. Additionally, a one time use random number could be added to messages to enhance security. These techniques may deter security attacks, such as replay, man-in-the-middle, and other types of security attacks.

If the object microprocessor 205 ascertains that a valid activation signal has been received by the object receiver 217, then the object microprocessor 205 may perform operation 524, which comprises outputting an acknowledgement transmit signal, to instruct the object transmitter 216 to transmit a valid activation signal acknowledgement signal. Operations 523 and 524 may be repeated one or more times, and may be repeated generally whenever the object unit 105 is operating.

Operation 525, which may be performed by the remote microprocessor 305 (or the microprocessor 405), comprises outputting a first transmit signal notification and a first power level indicator signal to instruct the remote transmitter 316 (or the transmitter 416) to transmit the valid activation signal at a first transmit power level. Operation 526 comprises determining if the remote receiver 317 (or the receiver 417) has received a valid activation signal acknowledgment signal in a prescribed period of time after the remote microprocessor 305 (or the microprocessor 405) outputs the first transmit signal notification. If the valid activation signal acknowledgment signal has been received in the prescribed period of time, then the sequence 500 may resume with operation 540 (discussed below). If the valid activation signal acknowledgment signal is not been received in the prescribed period of time, then operation 528 may be performed. Operation 528 comprises outputting a second transmit signal notification and a second power level indicator signal, to instruct the remote transmitter 316 (or the transmitter 416) to transmit the valid activation signal at a second transmit power level that is larger than the first transmit power level. In some examples the second transmit signal notification and the second power level indicator signal are outputted after the prescribed period of time, without determining if the remote receiver 317 (or the receiver 417) has received a valid activation signal acknowledgment signal in a prescribed period of time after the remote microprocessor 305 (or the microprocessor 405) outputs the first transmit signal notification. Operation 530 comprises determining if the remote receiver 317 (or the receiver 417) has received a valid activation signal acknowledgment signal in the prescribed period of time after the remote microprocessor 305 (or the microprocessor 405) outputs the second transmit signal notification. If the valid activation signal acknowledgment signal has been received in the prescribed period of time, then the sequence 500 may resume with operation 540 (discussed below). If the valid activation signal acknowledgment signal has not been received in the prescribed period of time, then operation 532 may be performed. Operation 532 comprises outputting a third transmit signal notification and a third power level indicator signal, to instruct the remote transmitter 316 (or the transmitter 416) to transmit the valid activation signal at a third transmit power level that is larger than the second transmit power level. In some examples the third transmit signal notification and the third power level indicator signal are outputted after the prescribed period of time, without determining if the remote receiver 317 (or the receiver 417) has received a valid activation signal acknowledgment signal in a prescribed period of time after the remote microprocessor 305 (or the microprocessor 405) outputs the second transmit signal notification. Operation 533 comprises determining if the remote receiver 317 (or the receiver 417) has received a valid activation signal acknowledgment signal in the prescribed period of time after the remote microprocessor 305 (or the microprocessor 405) outputs the third transmit signal notification. If the valid activation signal acknowledgment signal has been received in the prescribed period of time, then the sequence 500 may resume with operation 540 (discussed below). If the valid activation signal acknowledgment signal has not been received in the prescribed period of time, then operations 532 and 533 may be repeated. In some examples, a fourth (or more), transmit signal notification, and a fourth (or more) power level indicator signal, may be outputted to instruct the remote transmitter 316 (or the transmitter 416) to transmit the valid activation signal at a fourth (or higher) transmit power level that is larger than the preceding transmit power level.

The sequence 500 may continue with operation 538, after operation 516 or 522, or with operation 540 after operation 526, 530, or 533. In other examples the operations may be performed in different orders. Operation 538, which may be performed by the object microprocessor 205, comprises ascertaining whether a valid activation signal has been received by the object receiver 217, and if not, operation 538 may be repeated.

In some examples, the remote unit 110 includes a first sound selector switch 350 and a second sound selector switch 355. In some examples the first sound selector switch 350 and the second sound selector switch 355 may each be a momentary contact switch which may be moved to a select position by momentarily pressing the switch to momentarily connect (or alternatively, to momentarily disconnect) the contacts of the switch. In other examples, the first sound selector switch 350 and the second sound selector switch 355 may each be a single pole single throw switch, or a single pole double throw switch, which may be switched to a select position or to a non select position. In other examples, the first sound selector switch 350 and the second sound selector switch 355 may be embodied by one single pole double throw switch, which may be moved to a first position to select the first sound, or to a second position to select the second sound. When only one single pole double throw switch is used, the pole and one contact may be considered to be the first sound selector switch 350, and the pole and the other contact may be considered to be the second sound selector switch 355. Operation 540, comprises determining if a first sound selector switch 350 or a second sound selector switch 355 is provided in the system 100 (or alternatively, if the handheld device interface 408 is configured such that buttons on the handheld device 430 function as a first sound selector switch 350 or a second sound selector switch 355). If no first sound selector switch 350 or second sound selector switch 355 is provided (or if the handheld device interface 408 does not provide sound selector switch functionality), the sequence may continue at operation 564. If a first sound selector switch 350 or a second sound selector switch 355 is provided (or if the handheld device interface 408 is configured such that buttons on the handheld device 430 function as a first sound selector switch 350 or a second sound selector switch 355), the sequence may proceed with operation 541.

If a first sound selector switch 350 is included, operations 541 and 542 may be performed by the remote microprocessor 305 (or by the microprocessor 405 if a button on the handheld device 430 is provided with the functionality of the first sound selector switch). Operation 541 comprises determining if the first sound selector switch 350 (or a corresponding button on the handheld device 430) has been moved to a select position, and if so, operation 542, may be performed, which comprises outputting a digital sound file select signal, to instruct the remote transmitter 316 (or the transmitter 416) to output a digital sound file selection signal, to instruct the object unit 105 to select a first digital sound file.

In other examples, the first sound selector switch 350 could be pressed to cycle through a plurality of digital sound files (which may represent different tones), which are stored in the object unit 105, for example in the memory 206 and/or the memory 218, to select a digital sound file in the plurality of digital sound files. In this example, each time the first sound selector switch 350 (or a corresponding button on the handheld device 430) is pressed, the remote unit 110 (or the handheld device interface unit 403) could transmit a signal to the object unit 105, to cause a next digital sound file in the plurality of digital sound files, to be selected in the object unit 105. In this regard, operation 544, which may be performed by the remote microprocessor 305 (or the microprocessor 405) comprises determining if the first sound selector switch 350 (or a corresponding button on the handheld device 430) has been moved to a select position a second time, and if so, performing operation 546, which comprises outputting a digital sound file select signal again, to instruct the remote transmitter 316 (or the transmitter 416) to output an additional digital sound file selection signal, to instruct the object unit 105 to select a next digital sound file in the plurality of digital sound files. Operations 544 and 546 may be repeated.

If a second sound selector switch 355 is included, operations 548 and 550 may be performed by the remote microprocessor 305 (or by the microprocessor 405 if the handheld device interface 408 is configured such that a button on the handheld device 430 is provided with the functionality of the second sound selector switch 355). Operation 548 comprises determining if the second sound selector switch 355 (or a corresponding button on the handheld device 430) has been moved to a select position, and if so, operation 550 may be performed, which comprises outputting a second type digital sound file select signal, to instruct the remote transmitter 316 (or the transmitter 416) to output a second type digital sound file selection signal, to instruct the object unit 105 to select a second digital sound file.

Operation 552, which may be performed by the object microprocessor 205, comprises determining if the object receiver 217 has received a digital sound file selection signal (due to the first sound selector switch 350 or a corresponding button on the handheld device 430 being selected). If a digital sound file selection signal has been received, then the receipt of the digital sound file selection signal is recorded in operation 554, for example by setting a flag in a register. Operation 556, which may be performed by the object microprocessor 205, comprises determining if the object receiver 217 has received an additional digital sound file selection signal (due to the first sound selector switch 350 or a corresponding button on the handheld device 430 being selected again). If an additional digital sound file selection signal has been received, then the receipt of the additional digital sound file selection signal is recorded in operation 558, for example by setting a flag in a register. Operations 556 and 558 may be repeated if more than one additional digital sound file selection signal is received, so that the total number of received digital sound file selection signals is recorded. Operation 560, which may be performed by the object microprocessor 205, comprises determining if the object receiver 217 has received a second type digital sound file selection signal (due to the second sound selector switch 355 or a corresponding button on the handheld device 430 being selected). If a second type digital sound file selection signal has been received, then the receipt of the second type digital sound file selection signal is recorded in operation 562, for example by setting a flag in a register. In some examples, additional buttons could be provided on the remote unit 110 (or the handheld device 430), for causing third type, fourth type, or more digital sound file selection signals to be sent to the object unit 105, for specifying the selection of other digital sound files.

In other examples, rather than determining if the object receiver 217 has received a digital sound file selection signal or a second type digital sound file selection signal, operation 564 may be performed by the object microprocessor 205. Operation 564 comprises determining a state corresponding with each of the plurality of switches 224 to identify a digital sound file in a set of a plurality of digital sound files. In an alternative example, rather than determining the states of the switches 224, in operation 564, the object microprocessor 205 may read a previously loaded digital sound file identification register, to identify the digital sound file in the set of the plurality of digital sound files. The digital sound file may be stored in the memory 206 or the memory 218.

Operation 566, which may be performed by the object microprocessor 205, comprises reading a digital sound file from the memory 218 or from the memory 206. The digital sound file may be selected from a plurality of digital sound files stored in the memory 218 or the memory 206, or in both memories 218, 206. If the object unit 105 has received a digital sound file selection signal, then the digital sound file that is read from the memory 218 or the memory 206 may be a first digital sound file in the plurality of digital sound files (which is the result of the first sound selector switch 350 in the remote unit 210 being selected, or of a corresponding button in the handheld device 430 being pushed). If the object unit 105 has received an additional digital sound file selection signal, then the digital sound file that is read from the memory 218 or the memory 206 may be a second digital sound file in the plurality of digital sound files (which is the result of the first sound selector switch 350 in the remote unit 210, or a corresponding button in the handheld device 430, being selected a second time). If the object unit 105 receives another additional digital sound file selection signal, then the digital sound file that is read from the memory 218 or the memory 206 may be a third digital sound file in the plurality of digital sound files (which is the result of the first sound selector switch 350 in the remote unit 210, or a corresponding button in the handheld device 430, being selected a third time). If a second sound selector switch 355 is provided, if the object unit 105 receives a second type digital sound file selection signal, then the digital sound file that is read from the memory 218 or the memory 206 may be a second digital sound file in the plurality of digital sound files (which is the result of the second sound selector switch 355 in the remote unit 210, or a corresponding button in the handheld device 430, being selected).

Operation 568 comprises decoding the digital sound file that has been read from the memory 218 or the memory 206. In some examples operation 568 could be performed by a codec, which could be implemented in software in the object microprocessor 205, or which could be a hardware codec. In some examples, decoding the digital sound file may include converting the digital sound file to an analog signal, which for example, could be performed by a discrete digital to analog converter, or by a codec, or by the audio power amplifier 215 if the audio power amplifier 215 includes a digital to analog converter, or by the object microprocessor 205 if the object microprocessor 205 includes a digital to analog converter. In examples where the audio power amplifier 215 can receive a digital signal input, the digital sound file could remain in digital form, and in some cases, no decoding of the digital sound file would be necessary. Some examples may include operation 570, which may be performed by the object microprocessor 205, which comprises synthesizing sound signals in accordance with the digital sound file, for example if the digital sound file is a MIDI file. Some examples may include operation 572, which comprises outputting the decoded digital sound file, and which may be performed, for example, by the object microprocessor 205, or by a codec, or by a digital to analog converter. The decoded digital sound file that is outputted may be coupled to the input of the audio power amplifier 215, so the sound can be produced by the speaker 225. In some examples, operation 570 is performed before operation 572, and if so, the decoded digital sound file that is outputted in operation 572 is the sound signals that are synthesized in operation 570. In some examples, operation 572 may be performed before operation 568.

In some alternative embodiments, instead of performing operations 566-572, the output of an oscillator (or other type of audio signal generating circuit) could be coupled to the input of the audio power amplifier 215. Thus, in these alternative embodiments, the oscillator could be coupled to the input of the audio power amplifier 215, instead of reading, decoding, and outputting a digital sound file. In some examples, the oscillator could be provided as an additional sound source, which could be provided in addition to the digital sound files, and in other examples, the oscillator could be provided instead of the digital sound files.

Operation 574 comprises ascertaining whether the signal strength of the received valid activation signal is above a first threshold. Operation 574 may be performed, for example, by the object microprocessor 205. In some examples, the signal strength of the received valid activation signal may be obtained by the object microprocessor 205 from the object receiver 217, to enable the object microprocessor 205 to compare the signal strength to the first threshold (or to another threshold). The object receiver 217 may determine the signal strength by combining outputs from the plurality of logarithmic detectors 255 in the object receiver 217. If the signal strength of the received valid activation signal is not above a first threshold, then the object microprocessor 205 may perform operation 576, which comprises outputting a maximum sound level indicator signal. If the signal strength of the received valid activation signal is above the first threshold, then the object microprocessor 205 may output a second tier sound level indicator signal, which is selected as described below.

If the signal strength of the received valid activation signal is above the first threshold, then operation 578 may be performed, for example, by the object microprocessor 205. Operation 578 comprises ascertaining whether the signal strength of the received valid activation signal is above a second threshold. If the signal strength of the received valid activation signal is not above the second threshold, then the object microprocessor 205 may perform operation 580, which comprises selecting a second sound level indicator signal as the second tier sound level indicator.

If the signal strength of the received valid activation signal is above the second threshold, then operation 582 may be performed, for example, by the object microprocessor 205. Operation 582 comprises ascertaining whether the signal strength of the received valid activation signal is above a third threshold. If the signal strength of the received valid activation signal is not above the third threshold, then the object microprocessor 205 may perform operation 584, which comprises selecting a third sound level indicator signal as the second tier sound level indicator.

If the signal strength of the received valid activation signal is above the third threshold, then operation 586 may be performed, for example, by the object microprocessor 205. Operation 586 comprises ascertaining whether the signal strength of the received valid activation signal is above a fourth threshold. If the signal strength of the received valid activation signal is not above the fourth threshold, then the object microprocessor 205 may perform operation 588, which comprises selecting a fourth sound level indicator signal as the second tier sound level indicator.

If the signal strength of the received valid activation signal is above the fourth threshold, then operation 590 may be performed, for example, by the object microprocessor 205. Operation 590 comprises ascertaining whether the signal strength of the received valid activation signal is above a fifth threshold. If the signal strength of the received valid activation signal is not above the fifth threshold, then the object microprocessor 205 may perform operation 592, which comprises selecting a fifth sound level indicator signal as the second tier sound level indicator. If the signal strength of the received valid activation signal is above the fifth threshold, then operation 593 may be performed, for example by the object microprocessor 205. Operation 593 comprises selecting a sixth sound level indicator signal as the second tier sound level indicator. In some examples, more than six sound level indicator signals could be used.

The maximum sound level indicator signal, the second sound level indicator signal, the third sound level indicator signal, the fourth sound level indicator signal, the fifth sound level indicator signal, and the sixth sound level indicator signal, could be digital or analog signals that are used to control the output level of the audio power amplifier 215, for example, by controlling the gain of the audio power amplifier 215. As an example, the audio power amplifier could be a voltage controlled amplifier, or a digitally controlled amplifier. As an example, each of the sound level indicator signals could be a digital number, which could be converted to an analog voltage for controlling the output level of the audio power amplifier 215. In other examples, the output level of the audio power amplifier 215 could be directly controlled by the digital values of the sound level indicator signals. Any technique for controlling the output level of the audio power amplifier 215, in accordance with the sound level indicator signals, could be used. Alternatively, the maximum sound level indicator signal, the second sound level indicator signal, the third sound level indicator signal, the fourth sound level indicator signal, the fifth sound level indicator signal, and the sixth sound level indicator signal could be used to control the amplitude of the signal that is inputted to the audio power amplifier 215. For example, if the digital sound file is converted to analog before being inputted to the audio power amplifier 215, the maximum sound level indicator signal, the second sound level indicator signal, the third sound level indicator signal, the fourth sound level indicator signal, the fifth sound level indicator signal, and the sixth sound level indicator signal could be used to control the amplitude of the analog signal that is inputted to the audio power amplifier 215, for example, by controlling the gain of a preamplifier, or by controlling a variable resistance. Also, if the input to the audio power amplifier 215 is in digital form, then the digital input signal could be digitally processed with the maximum sound level indicator signal, the second sound level indicator signal, the third sound level indicator signal, the fourth sound level indicator signal, the fifth sound level indicator signal, or the sixth sound level indicator signal, to control the volume represented by the digital input signal.

Operation 594, which may be performed by the object microprocessor 205, and which may be performed after operations 576, 580, 584, 588, 592, or 593, comprises determining if the battery 230 coupled to the object microprocessor 205 is in a low voltage state. In other examples, operation 594 could be performed at other times in the sequence 500. Operation 594 may be repeated. If the object microprocessor 205 determines that the battery 230 coupled to the object microprocessor 205 is in a low voltage state, then the object microprocessor 205 may perform operation 596, which comprises outputting a low battery signal to instruct the object transmitter 216 to transmit a low battery notification signal. Operation 598, which may be performed by the remote microprocessor 305, comprises determining if the remote transmitter 316 has received the low battery notification signal. If the remote microprocessor 305 determines that the remote transmitter 316 has received the low battery notification signal, then the remote microprocessor 305 may perform operation 600, which comprises outputting a low battery indicator LED turn on signal, to cause the LED 330 of the remote unit 110 to illuminate. In other examples, the low battery notification signal could be received by the microprocessor 405 in the handheld device interface unit 403, and the microprocessor 405 could output a signal to cause an indicator on the handheld device 430 to indicate the low battery voltage condition.

Operation 602 comprises monitoring at least one vehicle property. As an example, the object microprocessor 205 may be coupled to the vehicle systems interface 250, which may be coupled to the vehicle computer 120, to facilitate monitoring the at least one vehicle property. Alternatively, the plurality of vehicle property sensors 125 could be coupled to the vehicle systems interface 250, or to the object microprocessor 205, to facilitate monitoring the at least one vehicle property. As an example, the at least one vehicle property could include acceleration, motion, directional orientation, vehicle temperature, engine temperature, whether lights are on, whether the doors are locked, whether a window is up or down, whether a sound system is on, whether the engine is on, whether the heater is on, whether the defroster is on, and whether the air conditioner is on. As an example, the plurality of vehicle property sensors may be sensors for sensing acceleration (accelerometer), motion (motion detector), directional orientation (vehicle directional orientation sensor), vehicle temperature (vehicle temperature sensor), engine temperature (engine temperature sensor), whether lights are on, whether the doors are locked, whether a window is up or down, whether a sound system is on, whether the engine is on, whether the heater is on, whether the defroster is on, and whether the air conditioner is on.

In operation 604, the object unit 105 could transmit a signal to the remote unit 110, to notify the remote unit 110 of information relating to a vehicle property. Alternatively, the signal could be transmitted to the handheld device interface unit 403, to notify the handheld device 430 of information relating to a vehicle property. As an example, the handheld device 430 could be a PDA, a mobile telephone, a handheld computer, or laptop computer. As an example, if motion of the vehicle 115 is sensed, a signal could be transmitted to the remote unit 110, and, as an example, an LED on the remote unit 110 could be flashed to indicate that vehicle motion has been detected. The LED 330, or an additional LED on the remote unit 110 could be used. In some examples, upon the occurrence of activity relating to a property of the vehicle 115, such as vehicle motion, a signal could be sent to the speaker 225 of the object unit 105, to produce sound (which, for example, could be sound produced from one of the digital sound files).

In some examples, at least one vehicle component may be remotely controlled. As an example, the object microprocessor 205 may be coupled to the vehicle systems interface 250, which may be coupled to the vehicle computer 120, to facilitate controlling the at least one vehicle component. As an example, the components of the vehicle 115 that could be controlled could include door locks, windows, lights, a sound system, the engine, the heater, the defroster, the air conditioner, and the horn. Generally, any component that could be controlled by vehicle computer 120 could be remotely controlled. In operation 606, to remotely control one or more vehicle components, the remote unit 110, responsive to a button on the remote unit 110 being pressed, (or the handheld device interface unit 403, responsive to a button being pressed on the handheld device 430), could transmit control information to the object unit 105. Operation 608, comprises receiving the control information, and could be performed by the receiver 217. Operation 610, which may be performed by the object microprocessor 205, comprises transmitting the control information to the vehicle systems interface 250. As an example, the object microprocessor 205 could transmit the control information to the vehicle systems interface 250, which could relay the vehicle control information to the vehicle computer 120, to control components of the vehicle 115.

When performing examples of the invention, the object unit 105 and the remote unit 110 (or the handheld device interface unit 403) may be separated by small or large distances. Generally, the object unit and the remote unit 110 (or the handheld device interface unit 403) may be separated by zero distance, or by distances in excess of 1,000 feet. In some specific examples the remote transmitter 316 (or the transmitter 416) may be located more than about 244 meters (about 800 feet) from the object receiver 217, and in other examples the remote transmitter 316 (or the transmitter 416) may be located more than about 274 meters (about 900 feet) from the object receiver 217, and in other examples remote transmitter 316 (or the transmitter 416) may be located more than about 305 meters (about 1,000 feet) from the object receiver 217. As an example, those distances could be the distance between a vehicle, and a person looking for the vehicle from different locations in a parking lot.

III. Additional Discussion

To use some examples of the system (also called an apparatus or device) of the invention to locate an object (such as a vehicle), a user pushes a button connected to a transmit switch 340 on the remote unit 110, which causes the remote unit 110 to transmit a radio frequency (RF) activation signal. The activation signal has a unique code, which may be user programmable, and if the code matches the code being used by the object unit 105, and if the activation signal is strong enough to be received by the object unit 105, then the audio power amplifier 215 of the object unit 105 outputs an electrical signal to a speaker 225, to cause the speaker 225 to produce sound (which may be a tone). The user can locate the vehicle by moving to the source of the sound.

The amplitude of the output signal from the audio power amplifier 215 of the object unit 105 may be a function of the signal strength of the electromagnetic signal (which may be an RF signal) received by the receiver 217 in the object unit 105. Consequently, if the user pushes a button coupled to the transmit switch 340 on the remote unit 110 when the user is distant from the vehicle 115, the received signal strength will be relatively smaller (for example, smaller than a designated threshold), and the sound produced by the speaker 225 will be relatively louder, to allow the user to hear the sound even when the user is distant from the vehicle 115. If the user pushes the button connected to the transmit switch 340 on the remote unit 110 when the user is relatively closer to the vehicle 115, the received signal strength will be relatively larger, (for example larger than the designated threshold), and the sound produced by the speaker 225 will be less loud, so the sound will not be uncomfortably loud when the user is near the vehicle 115, and to reduce the power consumed by the object unit 105 to conserve battery power. In other examples, the output power from the audio power amplifier 215 may be adjusted in a plurality of increments, inversely proportional to the received signal strength.

The sound produced by the speaker 225 of the object unit 105 may be called a tone, and the produced tone may be one of a plurality of different user selectable tones. A tone may be stored in a digital sound file. A digital sound file may be, for example, an MP3, WAV, or WMA, file, or any other type of audio file. In other examples the digital sound file could be a MID, MIDI file, or another type of file from which sound can be synthesized. Appropriate decoders for the sound files (such as an audio codec), and drivers for producing sound, may be provided in the object unit 105, and could be implemented with the microprocessor 205. As an example, tones may be selected by the user with switches 224 (which may be DIP switches) on the object unit 105, and/or in some examples, by downloading digital sound files into the object unit 105, for example using the USB port 240, or using the wireless communications port 245, communicatively coupled to, for example, a PDA, a personal computer, or a dedicated programming device. As an example, the digital sound files could be downloaded to the PDA, or to the personal computer, or to the dedicated programming device, from a remote site. In other examples, digital sound files could be loaded into the PDA, personal computer, or the dedicated programming device, from a CD, DVD, or other optical disc, or from flash memory, which, for example, could be any of the following: Memory Stick, Compact Flash, xD, SD, miniSD, RS-MMC, SmartMedia, MultiMediaCard, and/or a USB flash memory. A user may select a particular tone to distinguish the user's tone from other users. As an example, three dip switches could allow the user to select from 8 different tones, and four dip switches could allow the user to select from 16 different tones. If included in the system 100, the first sound selector switch 350 and the second sound selector switch 355 of the remote unit 110 also allow the user to select between different tones. In some embodiments, the first sound selector switch 350 or the second sound selector switch 355, could be pressed multiple times to scroll through a number of tones, to select one of the tones. Thus, the sound produced by the speaker 225 may be programmable by the user.

In some examples, the invention facilitates locating a vehicle 115 from a distance that is much greater than the operational range of fobs that are typically used for locking/unlocking doors or for arming/disarming an alarm on a vehicle. Some examples of the invention may facilitate locating a vehicle from a distance of about 350 meters (about 1,000 feet)(or more), which is about 20 times farther than conventional car alarms. Examples of the invention may achieve this operational range by using spread spectrum RF communications in unlicensed UHF ISM bands, a dipole antenna 220 coupled to the transceiver 210 of the object unit 105, and a retractable/extendable antenna 320 employed in the remote unit 110.

Using spread-spectrum technology decreases the potential of interfering with other electronic devices, and increases immunity from interference from the transmissions of other devices. Due to these characteristics, FCC regulations generally allow much higher RF power and more efficient antennas for spread-spectrum communications devices, compared to non-spread spectrum devices. As a result, the system 100 may have a much greater range than standard remote control devices. In some examples, very wide frequency deviation is used to beneficially utilize the spread spectrum capabilities of the transceivers 210, 310, 410. For example, a 225 KHz frequency deviation setting can be used. Also, in some examples, the transmit power can be programmed to +14 dBm. For receiving, in some examples a linear type of demodulation can be used, with an IF bandwidth of 600 kHz.

As discussed above, in some examples, rather than using only one-way communications from the remote unit 110 to the object unit 105, the object unit 105 and the remote unit 110 may each utilize a respective transceiver 210, 310, to permit two-way communications between the remote unit 110 and the object unit 105. The two-way communications capability facilitates features such as a remote unit "search" mode, in which the remote unit 110 periodically transmits an activation signal to the object unit 105, until the remote unit 110 receives an activation signal acknowledgement signal from the object unit 105 indicating that the object unit 105 has received the activation signal. The "search" mode, in which the remote unit 110 periodically transmits an activation signal to the object unit 105, may also be implemented in the one-way communications capability example, and in this instance the user may press a button on the remote unit 110 to terminate the search mode, when the user hears the sound from the speaker 225 on the vehicle 115. Also, the remote unit 110 may be configured to terminate the search mode after a prescribed time period. Two-way communications embodiments may also be utilized for communications between the handheld device interface unit 403 and the object unit 105.

The two-way communications capability may also be utilized to automatically adjust the transmit power level from the power amp 315 in the remote unit 110, by first transmitting at a low power level (which conserves battery power), and then increasing the transmit power level, if within a prescribed period of time, the remote unit 110 does not receive an activation signal acknowledgement signal from the object unit 105 indicating that the object unit 105 received a valid activation signal from the remote unit 110.

The two-way communications capability may also be utilized to transmit a signal from the object unit 105 to the remote unit 110, which indicates low remaining battery power in the object unit 105, and this signal may be used to activate a low battery indicator in the remote unit 110, to inform the user that the battery 230 for the object unit 105 is low. As an example, the low battery could be indicated by illuminating or flashing the LED 330 in the remote unit 110.

The two-way communications capability could be used to monitor vehicle properties, for example, acceleration, motion, directional orientation, vehicle temperature, engine temperature, whether lights are on, whether the doors are locked, whether one or more windows are up or down, whether a sound system is on, whether the engine is on, whether the heater is on, whether the defroster is on, and/or whether the air conditioner is on. In some examples the object unit 105 could be coupled to the vehicle computer 120, to remotely monitor and control components of the vehicle 115.

The two-way communications capability could also be utilized to implement an alternative embodiment wherein the object unit 105 periodically transmits a monitor signal, and wherein the remote unit 110 is permitted to transmit an activation signal only if the remote unit 110 receives the monitor signal.

In alternative embodiments, a specialized hardware unit, for example the handheld device interface unit 403, which could be coupled to a PDA, cell phone, handheld computer, or laptop computer, could be utilized to permit the PDA, cell phone, handheld computer, or laptop computer, in conjunction with the handheld device interface unit 403, to perform the functions of the remote unit 110. This could also permit location mapping and enhanced object unit status monitoring in the handheld device 430.

The object unit 105 may be implemented in a compact enclosure, and may be installed on a trunk lid or in any other suitable location of the vehicle 115. The object unit 105 may operate independently of the vehicle power, and may have an internal long-life battery, such as the battery 230. In some examples the object unit 105 may be coupled to the vehicle electrical power, for example, using the vehicle power interface 235.

Examples of the invention may conserve battery power in several ways. Some examples of the invention provide for conserving battery power in the remote unit 110, by allowing the user to select a high or low transmit power level, with the high transmit power level switch 345. As an example, the user may initially use the low transmit power setting, and only if necessary, will switch to the higher transmit power setting. In some examples, the default output power level may be set to "low" in order to maximize battery life, and the user may temporarily activate the "high" power mode if a response from the object unit 105 is not heard. In some examples the power setting may automatically reset to "low" power after each transmission from the remote unit 110, or after each time the transmit switch 340 is engaged. Also, the feature of having the object unit 105 adjust the loudness of the sound produced by the speaker 225 as a function of the distance between the object unit 105 and the remote unit 110 helps conserve battery power for the object unit 105, by producing a relatively louder sound only when necessary, when the remote unit 110 is relatively distant from the object unit 105. More specifically, the object unit 105 may produce variable sound volume depending on the perceived proximity of the transmitter 316 in the remote unit 110, to the receiver 217 in the object unit 105, based on processing of a Receive Signal Strength Indicator (RSSI) at the object unit 105. For example, a relatively weak signal typically would indicate that the remote unit 110 is distant from the object unit 110, thereby requiring louder sound. Because the audio power amplifier 215, at maximum volume, may consume 10 to 20 times the power of all of the other components in the object unit 105, reducing the audio volume can considerably extend the life of the battery 230. The amount of battery life extension will depend upon usage patterns. In this regard, the battery 230 will last longer if the user is relatively closer to the vehicle 115 when the user engages the transmit switch 340 in the remote unit 110. To further conserver power, the microprocessors 205, 305, 405 may be configured to enter a sleep mode wherein very little power is consumed, when appropriate. In the sleep mode, generally only the microprocessor's interrupt circuitry is operational, to permit the interrupt circuitry to wake up the microprocessor. For example, the microprocessor 305 could be awakened, if the transmit switch 340 on the remote unit 110 is engaged, or, the microprocessor 205 could be awakened, if a message is received by the transceiver 210 in the object unit 105. These power conserving features may be called "smart power management".

Various security enhancing measures may be employed. As an example, four bytes of flash memory may be reserved in the object unit 105, and in the remote unit 110, for a unique unit identifier which may be assigned to an object unit 105—remote unit 110 pair during manufacturing. This ID may be included in all messages, and messages that do not include the correct ID can be rejected. As an example, an eight bit ID may be included with messages. As a further security measure, each object unit 105—remote unit 110 pair may be assigned a unique frequency, for example within the 902-928 MHz band, during manufacturing, or in some examples, the system 100 could be configured to permit the user to select communications frequencies. Also, data may be transmitted using an error mitigation technique called interleaving, which provides an additional security benefit due to the use of a "seed" value in the interleaver. This seed values in the transmitter and receiver must be the same, and can be assigned differently to each object unit 105—remote unit 110 pair, thereby achieving a two-layer security scheme, which is much more difficult to "hack" than a one-layer system. Although there are a limited number of seed values, (256 is typical), this measure still reduces the likelihood that a system will be compromised.

For sending and receiving data between the transceiver 210 and the transceivers 310, 410, a data rate of 2 Kbps may be used, for example. Although a data rate as fast as 20 Kbps could probably be used, there would likely be decreased sensitivity and range at this faster data rate, and the faster data rate would not result in any improvement in response time that would be perceivable by a user.

When the Analog Devices Digital Modulation ISM Band Transceiver IC, model ADF7025, mentioned above, is functioning as a receiver, a clock interface signal provided by the transceiver IC can be used by a microcontroller or microprocessor, through a general-purpose I/O pin, for synchronously reading data from the transceiver IC. This Analog Devices transceiver IC does not provide built in integrity check features, but those features may be implemented in software. To reduce errors and increase message robustness, the messaging protocol for messages transmitted between the object unit 105, and the remote unit 110 (or the handheld device interface unit 403), may utilize Forward Error Correction (FEC), data interleaving, randomization, and Cyclic Redundancy Checks (CRC).

The following is an example of a data protocol that can be utilized: A five byte training sequence of alternating 1's and 0's is first; one synchronization byte follows next; one command byte (implying an "activate") follows next; one ID byte identifying the sender follows last. For robustness, the transmitter may send this sequence 3 times in succession. On the receiver side, once a training sequence has been detected with a proper Sync byte, the command and ID must match expected values or the command is ignored. If a full valid sequence is detected, the object unit 105 may sound the speaker 225 for a prescribed time period, for example 5 seconds, ignoring any additional messages during that time. Some examples may utilize Forward Error Correction (FEC), interleaving, or CRC checks to improve data integrity, but in other examples those techniques may be unnecessary.

In some examples of the invention, a watch-dog timer may be implemented for one or more of the microprocessors 205, 305, 405, and/or transceivers 210, 310, 410, so the hardware can be reset if one or more components become latched-up. As an example, the microprocessor 205 and the transceiver 210 could be reset if the microprocessor 205 becomes stuck in an error state in which the speaker 225 is constantly producing sound.

An example of operation of the transceiver 310 in the remote unit 110 is described in this paragraph. A Fractional-N phase-locked loop frequency synthesizer circuit may be used to perform RF signal generation and modulation functions. A low-cost crystal may be used in the reference oscillator, because a highly accurate center frequency is not required due to compensation circuits in the transceiver 310. The loop may be operated at twice the desired output center frequency, to prevent unwanted feedback from the power amplifier, and to simplify suppression of unwanted emissions. Data to be transmitted may be applied to a special modulation register in a fractional divider stage, and a control register may set the peak deviation of the resulting output waveform. The output of the synthesizer may be divided in frequency by a factor of two, and the resulting signal may be applied to a RF power amplifier stage. The RF output power may be adjustable via a control register setting. The transmit output of the transmitter 316 could be routed to an external filter, and to an antenna matching circuit which suppresses out-of-band emissions and optimizes power transfer to the antenna to achieve maximum efficiency. An extendable antenna 320 may be used, which permits having a small form-factor when the remote unit 110 is not being used. When the antenna 320 is in the extended position, transmit efficiency is maximized, thereby extending the activation range of the system 100. An efficient antenna minimizes the RF power required, resulting in extended battery life. The transmitter operational parameters may be controlled by firmware in the microprocessor 305. Control data may be transferred from the microprocessor 305 to the transceiver 310 using a bi-directional SPI interface. Communication data sequences containing a unit ID code and activation commands may be stored in the microprocessor flash memory, and may be applied to the data interface of the transceiver 310 during a transmission. In embodiments in which the receiver 317 in the transceiver 310 is not being used, the receiver circuits may be disabled to minimize power consumption.

Operation of the receiver 217 in the transceiver 210 of the object unit 105 is described in this paragraph. Receiver channel tuning may be provided by a fraction-N synthesizer. An automatic frequency control loop may be implemented in the receiver 217, which, due to the fine frequency step size of the synthesizer, permits the use of low cost reference oscillator components. The receiver 217 may use a direct-conversion architecture, which eliminates the requirement for external image rejection filters, thereby reducing cost and size. Quadrature downconversion mixers may be used to convert the tuned frequency to baseband. Matched I and Q lowpass filters may be used to reject off-channel interference prior to amplification and limiting of the signal. Outputs from logarithmic detectors 255 at each amplifier/limiter stage may be combined to provide a wide dynamic range signal strength indication, which may be used when implementing the power-saving feature in which the output of the audio power amplifier 215 is reduced proportional to the received signal strength. Demodulation may be accomplished in a digital discriminator, which may be followed by a post-detection filter and bit-slicer. The output of the bit-slicer is the recovered data, which may be routed, along with a synchronized clock, to the microprocessor 205. The receiver antenna 220 may be a vertical dipole, which provides better impedance stability and a better radiation pattern than a monopole antenna (which is typically used in portable applications). The antenna 220 may be routed to the receiver input via a matching network, to provide optimal power transfer and rejection of out-of-band signals. In embodiments where the transmitter 216 is not utilized, the transmit circuits in the transceiver 210 may be disabled to conserve power.

Generation of sound from the speaker 225 of the object unit 105 is discussed in this paragraph. The sound that is produced from the speaker 225, which may be called a tone or an alert tone or an alarm, may be synthesized algorithmically in the microprocessor 205, and converted to analog form using a PWM digital-to-analog converter that may be integral to the microprocessor 205. The analog waveform may be routed to the audio power amplifier 215, which may be a class-D audio power amplifier, and which may, as an example, drive an efficient piezo-electric speaker to produce the loud sound pressure levels necessary to provide audio range commensurate with the RF range.

USB port access to the object unit 105 is discussed in this paragraph. The object unit 105 may be configured to serve as a USB 2.0 slave device that can be attached to a PC or PDA or other device. As an example, the USB port 240 could be used to change a unique ID that may be assigned to the object unit 105, to permit using a new remote unit 110 (or possibly a second remote unit) with the object unit 105. The USB port 240 could also be used for updating firmware in the object unit 105. Also, the USB port 240 could be used for importing new or additional digital sound files (representing tones) into the object unit 105. Additionally, a software utility could be utilized to permit the user to set a PIN number, which in some examples, could be required for using the USB port 240. The PIN number may deter theft and reuse of the object unit 105 by a thief.

In some examples, a wireless communication port 245 could be used to perform the same functions as the USB port 240. In some examples both the USB port 240 and the wireless communication port 245 could be provided, and in other examples, either the USB port 245, or the wireless communication port 245 could be provided. A wireless programming transceiver could be used to communicate with the object unit 105 via the wireless communication port 245. As an example, the wireless programming transceiver could be connected to a web-enabled computer, to acquire firmware updates, or digital sound files representing tones. The wireless programming transceiver could then be disconnected from the computer, and the acquired information could be wirelessly transmitted from the wireless programming transceiver to the wireless communication port 245, to load the information into the object unit 105.

The following is an example of C-style pseudo code for the transmitter 316:

```
/* Transmitter Code */
    doInitializeCPU( ); /* Reset CPU timers and registers. Initialize
variables. */
    doInitializeXcvr(TRANSMIT_MODE); /* Load Transceiver registers
    via SPI*/
    /* Loop forever */
      while(FOREVER){
          /* Stay here until button press detected */
          while(BUTTON_NOT_PRESSED);
          /* Button press detected. Go send message */
          /* Set up loop to do 3 successive sends */
          for (loopcount = 0; loopcount < 3; loopcount++){
          /* Send 5 training bytes. Note SPI register loaded one byte at
a time */
              writeByte(TRAIN_BYTE);
              writeByte(TRAIN_BYTE);
              writeByte(TRAIN_BYTE);
              writeByte(TRAIN_BYTE);
              writeByte(TRAIN_BYTE);
              writeByte(SYNC_BYTE); /* Synchronization Byte */
              writeByte(COMMAND_BYTE); /* Command Byte */
              writeByte(ID_BYTE); /* Identification Byte */
          }/* End loopcount for loop*/
          /* Stay here until button press has been released*/
          while(BUTTON_PRESSED);
      }/* End FOREVER loop */
```

The following is an example of C-style pseudo code for the receiver 217:

```
    /* Receiver Code */
        doInitializeCPU( ); /* Reset CPU timers and registers. Initialize
variables. */
        doInitializeXcvr(RECEIVE_MODE); /* Load Transceiver
registers via SPI*/
        state = INIT0; /* Initialize the data read state machine */
        /* Loop forever */
            while(FOREVER){
                /* Process the state machine states based on read
data */
                if (state == INIT0){
                    /* Read data bit. If '1', then proceed to next
state. */
                    if (readDataBit( ) == 1)
                        state = INIT1;
                    else
                        state = INIT0;
                }else if (state == INIT1){
                    /* Read data bit. If '0', appears to be training
sequence so proceed*/
                    if (readDataBit( ) == 0)
                        state = TRAINING;
                    else
                        state = INIT0
                }else if (state == TRAINING){
                    /* In training sequence. Must detect at least 3
valid successive trains */
                    if ((readDataByte( ) == SYNC_BYTE) &&
                        (readDataByte( ) == SYNC_BYTE) &&
                        (readDataByte( ) == SYNC_BYTE))
                        state = SYNC;
                    else
                        state = INIT0;
                }else if (state == SYNC){
                    /* In sync sequence. Wait for end of train and
compare sync byte */
                    if (!syncCheck( ))
                        state = COMMAND;
                    else
                        state = INIT0;
                }else if (state == COMMAND){
                    /* In command byte check sequence. */
```

-continued

```
                    if (readDataByte( ) == COMMAND_BYTE)
                        state = ID;
                    else
                        state = INIT0;
                }else if (state == ID){
                    /* Command good. Now check ID.*/
                    if (readDataByte( ) == ID_BYTE){
                        /* We have a valid message.
Sound the horn */
                        setHornBit(ON); /* General purpose I/O bit -
Horn ON */
                        secDelay(5); /* Wait for 5 seconds */
                        setHornBit(OFF); /* General purpose I/O
bit - Horn OFF */
                    state = INIT0; /* Return to beginning of state
machine */
                }else{
                    state = INIT0; /* Return to beginning of state
machine */
                }/* End state machine For loop */
            }/* End FOREVER loop */
```

IV. Other Embodiments

The preceding disclosure describes a number of illustrative embodiments of the invention. It will be apparent to persons skilled in the art that various changes and modifications can be made to the described embodiments without departing from the scope of the invention as defined by the following claims. Also, although elements of the invention may be described or claimed herein in the singular, the plural is contemplated unless limitation to the singular is explicitly stated.

What is claimed is:

1. A system for locating an object, the system comprising:

an object electromagnetic receiver;

an audio amplifier;

an audio transducer coupled to the audio amplifier; and an object microprocessor coupled to the object electromagnetic receiver and the audio amplifier;

wherein the object microprocessor is configured to perform the following operations:

ascertaining whether a valid activation signal has been received by the object electromagnetic receiver, and if so:

reading a digital sound file; and ascertaining whether the signal strength of the received valid activation signal is above a first threshold, and if not:

outputting a maximum sound level indicator signal, and if so:

outputting a second tier sound level indicator signal.

2. The system of claim 1, wherein the object microprocessor is further configured to perform the following operations:

decoding the digital sound file; and outputting the decoded digital sound file.

3. The system of claim 1, wherein, if the signal strength of the received valid activation signal is above the first threshold, the object microprocessor is further configured to perform the operation of ascertaining whether the signal strength of the received valid activation signal is above a second threshold, and if not so, selecting a second sound level indicator signal as the second tier sound level indicator.

4. The system of claim 3, wherein, if the signal strength of the received valid activation signal is above the second threshold, the object microprocessor is further configured to perform the following operations:

ascertaining whether the signal strength of the received valid activation signal is above a third threshold, and if not so, selecting a third sound level indicator signal as the second tier sound level indicator, and if so:

ascertaining whether the signal strength of the received valid activation signal is above a fourth threshold, and if not so, selecting a fourth sound level indicator signal as the second tier sound level indicator, and if so:

ascertaining whether the signal strength of the received valid activation signal is above a fifth threshold, and if not so, selecting a fifth sound level indicator signal as the second tier sound level indicator.

5. The system of claim 1, wherein the object microprocessor has a memory, and wherein the object microprocessor is further configured to perform the operation of selecting the digital sound file from a plurality of digital sound files stored in the memory in the object microprocessor.

6. The system of claim 1, further comprising a memory coupled to the object microprocessor, wherein the object microprocessor is further configured to perform the operation of selecting the digital sound file from a plurality of digital sound files stored in the memory coupled to the object microprocessor.

7. The system of claim 1, further comprising a plurality of switches coupled to the object microprocessor, and wherein the object microprocessor is further configured to determine a state corresponding with each of the plurality of switches to identify the digital sound file in a set of a plurality of digital sound files.

8. The system of claim 1, wherein the valid activation signal includes a valid identification security code, and wherein the object microprocessor is further configured to perform the operation of reading a digital sound file identification register to identify the digital sound file in a set of a plurality of digital sound files.

9. The system of claim 1, wherein the object microprocessor is further configured to perform the operation of synthesizing sound signals in accordance with the digital sound file.

10. The system of claim 1, further comprising:

a transmit switch;

a remote electromagnetic transmitter;

a remote power amplifier coupled to the remote electromagnetic transmitter;

a remote microprocessor coupled to the transmit switch and the remote electromagnetic transmitter, wherein the remote microprocessor is configured to perform the following operations:

determining if the transmit switch has been engaged, and if so:

outputting a transmit signal notification, to instruct the remote electromagnetic transmitter to output the valid activation signal.

11. The system of claim 10:

further comprising a high transmit power level switch coupled to the remote microprocessor;

wherein the remote microprocessor is further configured to perform the following operations:

ascertaining whether the high transmit power level switch has been moved to a select position, and if so:

outputting a high transmit power indicator signal to instruct the remote electromagnetic transmitter to output the valid activation signal at a primary transmit power level when the remote electromagnetic transmitter receives the transmit signal notification;

and if not:

outputting a low transmit power indicator signal to instruct the remote electromagnetic transmitter to output the valid activation signal at a secondary transmit power level that is lower than the primary transmit power level when the remote electromagnetic transmitter receives the transmit signal notification.

12. The system of claim 10, further comprising:

a first sound selector switch coupled to the remote microprocessor; and a second sound selector switch coupled to the remote microprocessor;

and wherein the remote microprocessor is further configured to perform the following operations:

determining if the first sound selector switch has been moved to a select position, and if so, outputting a first digital sound file select signal, to instruct the remote electromagnetic transmitter to output a first digital sound file selection signal;

determining if the second sound selector switch has been moved to a select position, and if so, outputting a second digital sound file select signal, to instruct the remote electromagnetic transmitter to output a second digital sound file selection signal;

and wherein the object microprocessor is further configured to perform the following operations:

determining if the object electromagnetic receiver has received the first digital sound file selection signal, and if so:

the operation of reading a digital sound file comprises reading a first digital sound file;

and the operation of decoding the digital sound file comprises decoding the first digital sound file; and wherein the object microprocessor is further configured to perform the following operations:

determining if the object electromagnetic receiver has received the second digital sound file selection signal, and if so:

the operation of reading a digital sound file comprises reading a second digital sound file; and the operation of decoding the digital sound file comprises decoding the second digital sound file.

13. The system of claim 10, further comprising:

an object electromagnetic transmitter coupled to the object microprocessor;

a second electromagnetic power amplifier coupled to the object electromagnetic transmitter:

a remote electromagnetic receiver coupled to the remote microprocessor; and a transmit repeat selection switch coupled to the remote microprocessor;

wherein the remote microprocessor is further configured to perform the following operations:

ascertaining whether the transmit repeat selection switch has been moved to a select position, and if so:

periodically outputting the transmit signal notification, to instruct the remote electromagnetic transmitter to periodically output the valid activation signal;

ascertaining whether the remote electromagnetic receiver has received a valid activation signal acknowledgment signal, and if so:

terminating periodically outputting the transmit signal notification;

and wherein, if the object microprocessor ascertains that a valid activation signal has been received by the object electromagnetic receiver, the object microprocessor is further configured to output an acknowledgement transmit signal, to instruct the object electromagnetic transmitter to transmit the valid activation signal acknowledgement signal.

14. The system of claim 13, wherein the operation of periodically outputting the transmit signal notification comprises:

outputting a first transmit signal notification and a first power level indicator signal to instruct the remote electromagnetic transmitter to transmit the valid activation signal at a first transmit power level;

outputting a second transmit signal notification and a second power level indicator signal, to instruct the remote electromagnetic transmitter to transmit the valid activation signal at a second transmit power level that is larger than the first transmit power level, if the remote electromagnetic receiver has not received a valid activation signal acknowledgment signal in a prescribed period of time after the remote microprocessor outputs the first transmit signal notification.

15. The system of claim 14, wherein the operation of periodically outputting the transmit signal further comprises:

outputting a third transmit signal notification and a third power level indicator signal, to instruct the remote electromagnetic transmitter to transmit the valid activation signal at a third transmit power level that is larger than the second transmit power level, if the remote electromagnetic receiver has not received a valid activation signal acknowledgment signal in a prescribed period of time after the remote microprocessor outputs the second transmit signal notification.

16. The system of claim 13, further comprising:

a first sound selector switch coupled to the remote microprocessor; and a second sound selector switch coupled to the remote microprocessor;

and wherein the remote microprocessor is further configured to perform the following operations:

determining if the first sound selector switch has been moved to a select position, and if so, outputting a first digital sound file select signal, to instruct the remote electromagnetic transmitter to output a first digital sound file selection signal;

determining if the second sound selector switch has been moved to a select position, and if so, outputting a second digital sound file select signal, to instruct the remote electromagnetic transmitter to output a second digital sound file selection signal;

and wherein the object microprocessor is further configured to perform the following operations:

determining if the object electromagnetic receiver has received the first digital sound file selection signal, and if so:

the operation of reading a digital sound file comprises reading a first digital sound file;

and the operation of decoding the digital sound file comprises decoding the first digital sound file; and wherein the object microprocessor is further configured to perform the following operations:

determining if the object electromagnetic receiver has received the second digital sound file selection signal, and if so:

the operation of reading a digital sound file comprises reading a second digital sound file; and the operation of decoding the digital sound file comprises decoding the second digital sound file.

17. The system of claim 13, further comprising:

a battery coupled to the object electromagnetic receiver, the object microprocessor, and the audio amplifier; and a low battery indicator LED coupled to the remote microprocessor;

and wherein the object microprocessor is further configured to perform the following operations:

determining if the battery coupled to the object microprocessor is in a low voltage state, and if so, outputting a low battery signal to instruct the object electromagnetic transmitter to transmit a low battery notification signal;

and wherein the remote microprocessor is further configured to perform the following operations:

determining if the remote electromagnetic receiver has received the low battery notification signal, and if so, outputting a low battery indicator LED turn on signal.

18. The system of claim 10, wherein the object electromagnetic receiver is an RF receiver, and wherein the remote electromagnetic transmitter is an RF transmitter.

19. The system of claim 10, wherein the object is a vehicle.

20. The system of claim 10, further comprising:

an object electromagnetic transmitter coupled to the object microprocessor;

a remote electromagnetic receiver coupled to the remote microprocessor; and wherein the object microprocessor is further configured to perform the operation of periodically outputting a monitor signal to instruct the object electromagnetic transmitter to periodically transmit a monitor indication signal;

and wherein the operation of determining if the transmit switch has been engaged, further comprises determining if the remote electromagnetic receiver has received the monitor indication signal, and wherein the transmit signal notification is outputted by the remote microprocessor only if the transmit switch has been engaged and the monitor indication signal has been received by the remote electromagnetic receiver.

21. The system of claim 10, wherein the remote electromagnetic transmitter is located more than about 244 meters from the object electromagnetic receiver.

22. The system of claim 10, wherein the remote electromagnetic transmitter is located more than about 274 meters from the object electromagnetic receiver.

23. The system of claim 10, wherein the remote electromagnetic transmitter is located more than about 305 meters from the object electromagnetic receiver.

24. The system of claim 10, wherein the remote electromagnetic transmitter and the object electromagnetic receiver, and the object electromagnetic transmitter and the remote electromagnetic receiver utilize spread spectrum electromagnetic communications in UHF ISM bands.

25. The system of claim 1, further comprising a USB port coupled to the object microprocessor for inputting digital sound files.

26. The system of claim 1, further comprising a wireless communication port coupled to the object microprocessor for inputting digital information.

27. The system of claim 1, further comprising:

a battery coupled to the object electromagnetic receiver, the object microprocessor, and the audio amplifier; and a vehicle power interface coupled to the object electromagnetic receiver, the object microprocessor, and the audio amplifier.

28. The system of claim 1, further comprising:

an object electromagnetic transmitter coupled to the object microprocessor;

a second electromagnetic power amplifier coupled to the object electromagnetic transmitter:

a remote electromagnetic receiver coupled to the remote microprocessor; and wherein the object is a vehicle, and wherein the vehicle has a vehicle computer, and wherein the object microprocessor is coupled to the vehicle computer, and wherein the object microprocessor is further configured to perform the operation of monitoring at least one vehicle property, and wherein the at least one vehicle property includes vehicle motion.

29. The system of claim 1, further comprising:

an object electromagnetic transmitter coupled to the object microprocessor;

a second electromagnetic power amplifier coupled to the object electromagnetic transmitter:

a remote electromagnetic receiver coupled to the remote microprocessor;

and wherein the object is a vehicle having a vehicle computer, and further comprising:

a vehicle systems interface coupled to the object microprocessor, wherein the vehicle systems interface is configured to be coupled to the vehicle computer to remotely monitor and control components of the vehicle.

30. The system of claim 1, further comprising:

an object electromagnetic transmitter coupled to the object microprocessor;

a second electromagnetic power amplifier coupled to the object electromagnetic transmitter:

a remote electromagnetic receiver coupled to the remote microprocessor; and wherein the object is a vehicle, and further comprising:

a vehicle systems interface coupled to the object microprocessor; and a plurality of vehicle property sensors coupled to the vehicle systems interface.

31. The system of claim 30, wherein the plurality of vehicle property sensors include a motion detector.

32. The system of claim 30, wherein the plurality of vehicle property sensors include an accelerometer, a motion detector, a vehicle directional orientation sensor, and a vehicle temperature sensor.

33. The system of claim 1, further comprising:

a handheld device interface;

an electromagnetic transmitter;

an electromagnetic power amplifier coupled to the electromagnetic transmitter;

a second microprocessor coupled to the handheld device interface and the electromagnetic transmitter, wherein the second microprocessor is configured to perform the following operations:

determining if a transmit signal is received by the second microprocessor from the handheld device interface, and if so:

outputting a transmit signal notification, to instruct the electromagnetic transmitter to transmit the valid activation signal.

34. The system of claim 33, further comprising:

an object electromagnetic transmitter coupled to the object microprocessor;

a second electromagnetic power amplifier coupled to the object electromagnetic transmitter:

a second electromagnetic receiver coupled to the second microprocessor; and wherein the object is a vehicle, and wherein the handheld device interface transmits vehicle status information received from the second microprocessor.

35. The system of claim 34, wherein the handheld device interface transmits control signals to the second microprocessor for controlling the operation of windows and door locks attached to the vehicle.

36. The system of claim 1, wherein the object electromagnetic receiver includes a plurality of logarithmic detectors and amplifier stages, and wherein each logarithmic detector is coupled to a respective amplifier stage, and wherein the operation of ascertaining whether the signal strength of the received valid activation signal is above the first threshold comprises combining outputs from the plurality of logarithmic detectors.

37. A system for locating a vehicle, the system comprising:

a first RF receiver;

an audio power amplifier;

an audio transducer coupled to the audio power amplifier; and an object microprocessor coupled to the first RF receiver and the audio power amplifier;

wherein the object microprocessor is configured to perform the following operations:

ascertaining whether a valid activation signal has been received by the first RF receiver, and if so:

reading a digital sound file;

decoding the digital sound file;

outputting the decoded digital sound file;

ascertaining whether the signal strength of the received valid activation signal is above a first threshold, and if not so, outputting a maximum sound level indicator signal, and if so, outputting a second tier sound level indicator signal;

and wherein, if the signal strength of the received valid activation signal is above the first threshold, the object microprocessor is further configured to perform the operation of ascertaining whether the signal strength of the received valid activation signal is above a second threshold, and if not so, selecting a second sound level indicator signal as the second tier sound level indicator;

and wherein, if the signal strength of the received valid activation signal is above the second threshold, the object microprocessor is further configured to perform the operation of ascertaining whether the signal strength of the received valid activation signal is above a third threshold, and if not so, selecting a third sound level indicator signal as the second tier sound level indicator;

and wherein, if the signal strength of the received valid activation signal is above the third threshold, the object microprocessor is further configured to perform the operation of ascertaining whether the signal strength of the received valid activation signal is above a fourth threshold, and if not so, selecting a fourth sound level indicator signal as the second tier sound level indicator;

and wherein, if the signal strength of the received valid activation signal is above the fourth threshold, the object microprocessor is further configured to perform the operation of ascertaining whether the signal strength of the received valid activation signal is above a fifth threshold, and if not so, selecting a fifth sound level indicator signal as the second tier sound level indicator;

and wherein the system further comprises:

a transmit switch;

a remote RF transmitter;

a first RF power amplifier coupled to the remote RF transmitter;

a remote microprocessor coupled to the transmit switch and the remote RF transmitter, wherein the remote microprocessor is configured to perform the following operations:

determining if the transmit switch has been pushed, and if so:

outputting a transmit signal notification, to cause the remote RF transmitter to output the valid activation signal;

and wherein the system further comprises a power level button coupled to the remote microprocessor;

and wherein the remote microprocessor is further configured to perform the following operations:

ascertaining whether the power level button has been pushed, and if so:

outputting a high transmit power indicator signal to cause the remote RF transmitter to output the valid activation signal at a primary transmit power level;

and if not:

outputting a low transmit power indicator signal to cause the remote RF transmitter to output the valid activation signal at a secondary transmit power level that is lower than the primary transmit power level.

38. The system of claim 37, further comprising:

a first sound select button coupled to the remote microprocessor; and a second sound select button coupled to the remote microprocessor;

and wherein the remote microprocessor is further configured to perform the following operations:

determining if the first sound select button has been pushed, and if so, outputting a first digital sound file select signal, to instruct the remote RF transmitter to output a first digital sound file selection signal;

determining if the second sound select button has been pushed, and if so, outputting a second digital sound file select signal, to instruct the remote RF transmitter to output a second digital sound file selection signal;

and wherein the object microprocessor is further configured to perform the following operations:

determining if the first RF receiver has received the first digital sound file selection signal, and if so:

the operation of reading a digital sound file comprises reading a first digital sound file;

and the operation of decoding the digital sound file comprises decoding the first digital sound file; and wherein the object microprocessor is further configured to perform the following operations:

determining if the first RF receiver has received the second digital sound file selection signal, and if so:

the operation of reading a digital sound file comprises reading a second digital sound file; and the operation of decoding the digital sound file comprises decoding the second digital sound file.

39. The system of claim 37:

wherein the object microprocessor is further configured to perform the operation of periodically outputting a monitor signal to instruct the second RF transmitter to periodically transmit a monitor indication signal;

wherein the remote microprocessor is configured to output the valid activation signal only after detecting that the second RF receiver has received the monitor indication signal.

40. A system for locating a motor vehicle, the system comprising:

a first RF receiver;

an audio power amplifier;

an audio transducer coupled to the audio power amplifier;

a memory; and an object microprocessor coupled to the first RF receiver, the audio power amplifier, and the memory;

wherein the object microprocessor is configured to perform the following operations:

ascertaining whether a valid activation signal has been received by the first RF receiver, wherein the valid activation signal includes a valid identification security code, and if so:

selecting a digital sound file from a plurality of digital sound files stored in the memory;

reading the digital sound file from the memory;

decoding the digital sound file;

outputting the decoded digital sound file;

ascertaining whether the signal strength of the received valid activation signal is above a first threshold, and if not, outputting a maximum sound level indicator signal, and if so, outputting a second tier sound level indicator signal;

and wherein, if the signal strength of the received valid activation signal is above the first threshold, the object microprocessor is further configured to perform the operation of ascertaining whether the signal strength of the received valid activation signal is above a second threshold, and if not so, selecting a second sound level indicator signal as the second tier sound level indicator;

and wherein, if the signal strength of the received valid activation signal is above the second threshold, the object microprocessor is further configured to perform the operation of ascertaining whether the signal strength of the received valid activation signal is above a third threshold, and if not so, selecting a third sound level indicator signal as the second tier sound level indicator;

and wherein, if the signal strength of the received valid activation signal is above the third threshold, the object microprocessor is further configured to perform the operation of ascertaining whether the signal strength of the received valid activation signal is above a fourth threshold, and if not so, selecting a fourth sound level indicator signal as the second tier sound level indicator;

and wherein, if the signal strength of the received valid activation signal is above the fourth threshold, the object microprocessor is further configured to perform the operation of ascertaining whether the signal strength of the received valid activation signal is above a fifth threshold, and if not so, selecting a fifth sound level indicator signal as the second tier sound level indicator;

and wherein the system further comprises:

a transmit switch;

a remote RF transmitter;

a first RF power amplifier coupled to the remote RF transmitter;

a remote microprocessor coupled to the transmit switch and the remote RF transmitter, wherein the remote microprocessor is configured to perform the following operations:

determining if the transmit switch has been pushed, and if so:

outputting a transmit signal notification, to cause the remote RF transmitter to output the valid activation signal;

and wherein the system further comprises:

a second RF transmitter coupled to the object microprocessor;

a second RF power amplifier coupled to the second RF transmitter;

a second RF receiver coupled to the remote microprocessor; and a transmit repeat selection switch coupled to the remote microprocessor;

and wherein the remote microprocessor is further configured to perform the following operations:

ascertaining whether the transmit repeat selection switch has been pushed, and if so, periodically outputting the transmit signal notification, to cause the remote RF transmitter to periodically output the valid activation signal;

ascertaining whether the second RF receiver has received a valid activation signal acknowledgment signal, and if so, terminating periodically outputting the transmit signal notification;

and wherein, if the object microprocessor ascertains that a valid activation signal has been received by the first RF receiver, the object microprocessor is further configured to output an acknowledgement transmit signal, to cause the second RF transmitter to transmit the valid activation signal acknowledgement signal;

wherein the operation of periodically outputting the transmit signal comprises:

outputting a first transmit signal notification and a first power level indicator signal to cause the remote RF transmitter to transmit the valid activation signal at a first transmit power level;

outputting a second transmit signal notification and a second power level indicator signal, to cause the remote RF transmitter to transmit the valid activation signal at a second transmit power level that is larger than the first transmit power level, if the second RF transmitter has not received a valid activation signal acknowledgment signal in a prescribed period of time after outputting the first transmit signal notification; and outputting a third transmit signal notification and a third power level indicator signal, to cause the remote RF transmitter to transmit the valid activation signal at a third transmit power level that is larger than the second transmit power level, if the second RF transmitter has not received a valid activation signal acknowledgment signal in a prescribed period of time after outputting the second transmit signal notification;

and wherein the system further comprises:

a USB port coupled to the object microprocessor for inputting digital sound files;

a battery coupled to the first RF receiver, the object microprocessor, the audio power amplifier, the second RF transmitter, and the second RF power amplifier;

a vehicle power interface coupled to the object microprocessor;

a dipole antenna coupled to the first RF receiver; and a selectably retractable and extendable antenna coupled to the remote RF transmitter.

41. The system of claim 40:

wherein the object microprocessor is further configured to perform the operation of periodically outputting a monitor signal to instruct the second RF transmitter to periodically transmit a monitor indication signal;

and wherein the remote microprocessor is configured to output the valid activation signal only after detecting that the second RF receiver has received the monitor indication signal.

42. The system of claim 41, further comprising:

a first sound select button coupled to the remote microprocessor; and a second sound select button coupled to the remote microprocessor;

and wherein the remote microprocessor is further configured to perform the following operations:

determining if the first sound select button has been pushed, and if so, outputting a first digital sound file select signal, to instruct the remote RF transmitter to output a first digital sound file selection signal;

determining if the second sound select button has been pushed, and if so, outputting a second digital sound file select signal, to instruct the remote RF transmitter to output a second digital sound file selection signal;

and wherein the object microprocessor is further configured to perform the following operations:

determining if the first RF receiver has received the first digital sound file selection signal, and if so:

the operation of reading a digital sound file from the memory comprises reading a first digital sound file from the memory;

the operation of decoding the digital sound file comprises decoding the first digital sound file; and wherein the object microprocessor is further configured to perform the following operations:

determining if the first RF receiver has received the second digital sound file selection signal, and if so:

the operation of reading a digital sound file from the memory comprises reading a second digital sound file from the memory; and the operation of decoding the digital sound file comprises decoding the second digital sound file.

43. A system for locating an object, the system comprising:

first means for receiving electromagnetic signals;

means for amplifying audio signals;

means for producing sound from electrical signals, coupled to the means for amplifying audio signals;

means for storing information;

first means for processing instructions and data, wherein the first means for processing instructions and data is coupled to the first means for receiving electromagnetic signals, the means for amplifying audio signals, and the means for storing information;

means for ascertaining whether a valid activation signal has been received by the first means for receiving electromagnetic signals;

means for reading a digital sound file from the means for storing information;

means for decoding the digital sound file;

means for outputting the decoded digital sound file;

means for ascertaining whether the signal strength of the received valid activation signal is above a first threshold;

means for outputting a maximum sound level indicator signal;

means for outputting a second tier sound level indicator signal;

a transmit switch;

first means for transmitting electromagnetic signals;

first means for amplifying electromagnetic signals, coupled to the first means for transmitting electromagnetic signals;

second means for processing instructions and data, wherein the second means for processing instructions and data is coupled to the transmit switch and the first means for transmitting electromagnetic signals;

means for determining if the transmit switch has been pushed; and means for outputting a transmit signal notification, to instruct the first means for transmitting electromagnetic signals to output the valid activation signal.

44. The system of claim 43, further comprising:

second means for transmitting electromagnetic signals, coupled to the first means for processing information and data;

second means for amplifying electromagnetic signals, coupled to the second means for transmitting electromagnetic signals;

second means for receiving electromagnetic signals, coupled to the second means for processing instructions and data; and a transmit repeat selection switch coupled to the second means for processing instructions and data;

and wherein the second means for processing instructions and data is configured to perform the following operations:

ascertaining whether the transmit repeat selection switch has been pushed, and if so, periodically outputting the transmit signal notification, to instruct the first means for transmitting electromagnetic signals to periodically output the valid activation signal; and ascertaining whether the second means for receiving electromagnetic signals has received a valid activation signal acknowledgment signal, and if so, terminating periodically outputting the transmit signal notification;

and wherein, if the first means for processing instructions and data ascertains that a valid activation signal has been received by the first means for receiving electromagnetic signals, the first means for processing instructions and data is further configured to output an acknowledgement transmit signal, to instruct the second means for transmitting electromagnetic signals to transmit the valid activation signal acknowledgement signal.

45. A method for locating an object, the method comprising the following operations:

determining if a transmit switch has been pushed, and if so, outputting a transmit signal notification, to cause a remote electromagnetic transmitter to output a valid activation signal;

ascertaining whether the valid activation signal has been received by an object electromagnetic receiver attached to the object, and if so:

reading a digital sound file from a memory;

decoding the digital sound file;

ascertaining whether the signal strength of the received valid activation signal is above a first threshold, and if not:

outputting a maximum sound level indicator signal, and if so:

outputting a second tier sound level indicator signal;

wherein, if the signal strength of the received valid activation signal is above the first threshold, the operations further comprise ascertaining whether the signal strength of the received valid activation signal is above a second threshold, and if not so, selecting a second sound level indicator signal as the second tier sound level indicator.

46. The method of claim 45, wherein the operations further comprise:

ascertaining whether the signal strength of the received valid activation signal is above a third threshold, and if not so, selecting a third sound level indicator signal as the second tier sound level indicator, and if so:

ascertaining whether the signal strength of the received valid activation signal is above a fourth threshold, and if not so, selecting a fourth sound level indicator signal as the second tier sound level indicator, and if so:

ascertaining whether the signal strength of the received valid activation signal is above a fifth threshold, and if not so, selecting a fifth sound level indicator signal as the second tier sound level indicator.

47. The method of claim 45, wherein the operations further comprise selecting the digital sound file from a plurality of digital sound files stored in the memory, and outputting the decoded digital sound file.

48. The method of claim 45, wherein the operations further comprise determining a state corresponding with each of a plurality of switches to identify the digital sound file in a set of a plurality of digital sound files.

49. The method of claim 45, wherein the operations further comprise reading a digital sound file identification register to identify the digital sound file in a plurality of digital sound files.

50. The method of claim 45, wherein the operations further comprise synthesizing sound signals in accordance with the digital sound file.

51. The method of claim 45, wherein the operations further comprise:

determining if a first sound has been selected, and if so, outputting a first digital sound file select signal, to instruct the remote electromagnetic transmitter to output a first digital sound file selection signal;

determining if a second sound has been selected, and if so, outputting a second digital sound file select signal, to instruct the remote electromagnetic transmitter to output a second digital sound file selection signal;

determining if the object electromagnetic receiver has received the first digital sound file selection signal, and if so, the operation of reading a digital sound file from the memory comprises reading a first digital sound file from the memory, and the operation of decoding the digital sound file comprises decoding the first digital sound file; and determining if the object electromagnetic receiver has received the second digital sound file selection signal, and if so, the operation of reading a digital sound file from the memory comprises reading a second digital sound file from the memory, and the operation of decoding the digital sound file comprises decoding the second digital sound file.

52. The method of claim 45, wherein the operations further comprise:

determining if a sound selector switch has been engaged a first time, and if so, outputting a first digital sound file select signal, to instruct the remote electromagnetic transmitter to output a first digital sound file selection signal;

determining if the sound selector switch has been engaged second time, and if so, outputting a second digital sound file select signal, to instruct the remote electromagnetic transmitter to output a second digital sound file selection signal.

53. The method of claim 45, wherein the operations further comprise:

ascertaining whether a power level button has been pushed, and if so:

outputting a high transmit power indicator signal to instruct the remote electromagnetic transmitter to output the valid activation signal at a primary transmit power level;

and if not:

outputting a low transmit power indicator signal to instruct the remote electromagnetic transmitter to output the valid activation signal at a secondary transmit power level that is lower than the primary transmit power level.

54. The method of claim 45:

wherein the operations further comprise ascertaining whether a transmit repeat selection switch has been pushed, and if so, periodically outputting the transmit signal notification, and periodically outputting the valid activation signal;

and if the valid activation signal has been received by the object electromagnetic receiver, the operations further comprise outputting an acknowledgement transmit signal, and transmitting the valid activation signal acknowledgement signal;

and wherein the operations further comprise ascertaining whether a remote electromagnetic receiver has received a valid activation signal acknowledgment signal, and if so, terminating periodically outputting the transmit signal notification.

55. The method of claim 54, wherein the operation of periodically outputting the transmit signal notification comprises:

outputting a first transmit signal notification and a first power level indicator signal to instruct the remote electromagnetic transmitter to transmit the valid activation signal at a first transmit power level; and outputting a second transmit signal notification and a second power level indicator signal, to instruct the remote electromagnetic transmitter to transmit the valid activation signal at a second transmit power level that is larger than the first transmit power level, if the remote electromagnetic receiver has not received a valid activation signal acknowledgment signal in a prescribed period of time after the remote microprocessor outputs the first transmit signal notification.

56. The method of claim 45, wherein the object is a vehicle, and wherein the operations further comprise remotely monitoring at least one property of the vehicle.

57. The method of claim 45, wherein the object is a vehicle, and wherein the operations further comprise remotely controlling at least one component of the vehicle.

58. The method of claim 45, wherein the object is a vehicle, and wherein the operations further comprise:

transmitting vehicle status information from the vehicle to a handheld device interface unit; and transmitting control signals from a handheld device to the handheld device interface for controlling the operation of windows and door locks attached to the vehicle.

59. The method of claim 45, wherein the operations further comprise:

determining if a battery is in a low voltage state, and if so, outputting a low battery signal, and transmitting a low battery notification signal; and determining if the low battery notification signal has been received, and if so, outputting a low battery indicator LED turn on signal.

60. The method of claim 45, wherein the operations further comprise:

determining if a transmit signal is received from a handheld device interface, and if so, outputting a second transmit signal notification, and transmitting the valid activation signal.

61. The method of claim 45, wherein the operations further comprise:

periodically outputting a monitor signal to instruct an object electromagnetic transmitter to periodically transmit a monitor indication signal; and outputting the valid activation signal only after detecting that a remote electromagnetic receiver has received the monitor indication signal.

* * * * *